US011158245B2

(12) United States Patent
Yum et al.

(10) Patent No.: US 11,158,245 B2
(45) Date of Patent: Oct. 26, 2021

(54) ELECTROLUMINESCENT DISPLAY DEVICE AND METHOD OF COMPENSATING LUMINANCE IN THE SAME

(71) Applicant: SAMSUNG ELECTRONICS CO., LTD., Suwon-si (KR)

(72) Inventors: Joohyuk Yum, Yongin-si (KR); Yonghoon Yu, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/816,456

(22) Filed: Mar. 12, 2020

(65) Prior Publication Data

US 2021/0020098 A1 Jan. 21, 2021

(30) Foreign Application Priority Data

Jul. 16, 2019 (KR) ..... 10-2019-0085444
Nov. 22, 2019 (KR) ..... 10-2019-0151061

(51) Int. Cl.

| | |
|---|---|
| ***G09G 3/3208*** | (2016.01) |
| ***G09G 3/3225*** | (2016.01) |
| ***G09G 3/3233*** | (2016.01) |
| ***G09G 3/3275*** | (2016.01) |
| ***G09G 3/3283*** | (2016.01) |

(52) U.S. Cl.

CPC ..... *G09G 3/3208* (2013.01); *G09G 3/3225* (2013.01); *G09G 3/3233* (2013.01); *G09G 3/3275* (2013.01); *G09G 3/3283* (2013.01); *G09G 2320/0276* (2013.01); *G09G 2320/0673* (2013.01); *G09G 2360/16* (2013.01)

(58) Field of Classification Search

CPC ..... G09G 3/3208; G09G 3/3225–3233; G09G 3/3258; G09G 3/3283; G09G 2320/0673; G09G 2320/0276; G09G 2320/0223; G09G 2320/0233; G09G 2320/0242; G09G 2320/0626; G09G 3/3275–3291; G09G 2360/16

See application file for complete search history.

(56) References Cited

U.S. PATENT DOCUMENTS

| | | | |
|---|---|---|---|
| 6,188,454 | B1 | 2/2001 | Greene et al. |
| 6,774,875 | B2 | 8/2004 | Tong et al. |
| 7,804,509 | B2 | 9/2010 | Thebault et al. |
| 8,232,987 | B2 | 7/2012 | Park et al. |
| 9,552,763 | B2 | 1/2017 | Chun et al. |

(Continued)

*Primary Examiner* — Xuemei Zheng

(74) *Attorney, Agent, or Firm* — Sughrue Mion, PLLC

(57) ABSTRACT

A method of compensating luminance in an electroluminescent display device including a display panel including pixels is provided. A global current value is generated based on input pixel values corresponding to the pixels where the global current value indicates a global current flowing through the display panel. With respect to each of the input pixel values, a global compensation value indicating a global luminance deviation according the global current is generated based on the input pixel value and the global current value. A gamma compensation value indicating a gamma distortion is generated based on the input pixel value where the gamma distortion is caused by compensating the input pixel value. A compensated pixel value is generated based on the input pixel value, the global compensation value and the gamma compensation value.

20 Claims, 19 Drawing Sheets

(56) References Cited

U.S. PATENT DOCUMENTS

| | | | | |
|---|---|---|---|---|
| 9,583,045 | B2 | 2/2017 | Chen et al. | |
| 9,715,849 | B2 | 7/2017 | Fujii | |
| 10,096,278 | B2 | 10/2018 | Kim et al. | |
| 2008/0170014 | A1 | 7/2008 | Jung et al. | |
| 2014/0176620 | A1 | 6/2014 | Yano et al. | |
| 2016/0118022 | A1* | 4/2016 | Chun | G09G 3/2007 345/690 |
| 2020/0279519 | A1* | 9/2020 | Orio | G09G 3/006 |

* cited by examiner

FIG. 7

| PIXEL VALUE \ Avg | 0 | 2 | 3 | 8 | 14 | 24 | 35 | 49 | 66 | 83 | 106 | 129 | 157 | 186 | 221 | 255 |
|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 |
| 2 | 0 | 0 | 0 | 0 | 0 | 0 | 1 | 2 | 3 | 3 | 4 | 5 | 6 | 6 | 6 | 6 |
| 3 | 0 | 0 | 0 | 0 | 0 | 0 | 2 | 4 | 6 | 8 | 9 | 9 | 9 | 10 | 11 | 11 |
| 8 | -1 | -1 | 0 | 0 | 0 | 0 | 4 | 7 | 11 | 14 | 18 | 23 | 27 | 31 | 32 | 32 |
| 14 | -4 | -3 | -2 | 0 | 0 | 0 | 4 | 9 | 14 | 20 | 26 | 33 | 41 | 48 | 54 | 57 |
| 24 | -8 | -7 | -6 | -4 | -1 | 0 | 3 | 8 | 15 | 22 | 30 | 39 | 48 | 59 | 69 | 78 |
| 35 | -14 | -13 | -12 | -10 | -7 | -3 | 0 | 5 | 13 | 21 | 29 | 39 | 49 | 61 | 73 | 86 |
| 49 | -21 | -20 | -19 | -16 | -13 | -10 | -5 | 0 | 6 | 15 | 24 | 33 | 44 | 56 | 69 | 83 |
| 66 | -29 | -28 | -27 | -24 | -21 | -17 | -12 | -6 | 0 | 7 | 16 | 25 | 36 | 48 | 62 | 76 |
| 83 | -38 | -37 | -36 | -33 | -30 | -26 | -21 | -15 | -7 | 0 | 8 | 17 | 29 | 41 | 55 | 70 |
| 106 | -49 | -48 | -46 | -44 | -40 | -36 | -30 | -24 | -16 | -8 | 0 | 9 | 21 | 34 | 49 | 63 |
| 129 | -61 | -60 | -58 | -56 | -52 | -47 | -41 | -34 | -26 | -18 | -9 | 0 | 11 | 25 | 40 | 54 |
| 157 | -75 | -74 | -73 | -70 | -66 | -61 | -54 | -47 | -39 | -31 | -21 | -11 | 0 | 12 | 28 | 41 |
| 186 | -91 | -90 | -88 | -85 | -81 | -75 | -69 | -62 | -54 | -45 | -35 | -24 | -12 | 0 | 13 | 26 |
| 221 | -108 | -107 | -105 | -102 | -97 | -91 | -85 | -77 | -69 | -60 | -50 | -38 | -26 | -13 | 0 | 12 |
| 255 | -127 | -124 | -122 | -118 | -114 | -108 | -101 | -93 | -84 | -75 | -64 | -53 | -40 | -27 | -12 | 0 |

FIG. 13A

| OPR | BLK | IMG1 | IMG2 | IMG3 | IMG4 | IMG5 | IMG6 |
|---|---|---|---|---|---|---|---|
| 10% | 121.9% | 116.4% | 113.9% | 108.8% | 112.5% | 118.9% | 118.1% |
| 20% | 118.5% | 114.9% | 112.3% | 107.6% | 111.0% | 116.5% | 115.7% |
| 30% | 115.6% | 112.8% | 110.5% | 106.4% | 109.2% | 113.8% | 113.4% |
| 40% | 112.8% | 110.8% | 108.9% | 105.3% | 107.8% | 111.3% | 111.4% |
| 50% | 110.3% | 108.9% | 107.3% | 104.4% | 106.5% | 109.1% | 109.6% |
| 60% | 107.8% | 107.0% | 105.6% | 103.4% | 105.2% | 107.0% | 107.4% |
| 70% | 105.6% | 105.1% | 104.1% | 102.5% | 103.8% | 105.1% | 105.4% |
| 80% | 103.6% | 103.3% | 102.7% | 101.6% | 102.5% | 103.3% | 103.5% |
| 90% | 101.8% | 101.6% | 101.3% | 100.8% | 101.3% | 101.7% | 10.6% |

FIG. 13B

| OPR | BLK | IMG1 | IMG2 | IMG3 | IMG4 | IMG5 | IMG6 |
|---|---|---|---|---|---|---|---|
| 10% | 99.3% | 99.4% | 100.1% | 99.7% | 99.8 | 99.1% | 99.3% |
| 20% | 99.5% | 99.6% | 100.1% | 99.7% | 99.8 | 99.4% | 99.5% |
| 30% | 99.6% | 99.5% | 99.9% | 99.7% | 99.6 | 99.4% | 99.4% |
| 40% | 99.6% | 99.8% | 99.9% | 99.7% | 99.6 | 99.4% | 99.6% |
| 50% | 99.7% | 100.0% | 100.2% | 100.0% | 100.0 | 99.7% | 99.8% |
| 60% | 100.0% | 100.0% | 100.1% | 99.8% | 99.9 | 99.8% | 99.8% |
| 70% | 99.9% | 100.1% | 100.1% | 99.8% | 99.8 | 99.8% | 99.9% |
| 80% | 99.8% | 100.1% | 100.0% | 99.8% | 99.8 | 99.8% | 99.9% |
| 90% | 99.8% | 99.9% | 100.1% | 99.9% | 99.9 | 99.7% | 99.8% |

ELECTROLUMINESCENT DISPLAY DEVICE AND METHOD OF COMPENSATING LUMINANCE IN THE SAME

CROSS-REFERENCE TO RELATED APPLICATION

This U.S. non-provisional application claims priority under 35 USC § 119 to Korean Patent Application No. 10-2019-0085444, filed on Jul. 16, 2019, and Korean Patent Application No. 10-2019-0151061, filed on Nov. 22, 2019, in the Korean Intellectual Property Office (KIPO), the disclosures of each of which are incorporated by reference herein in their entireties.

BACKGROUND

1. Technical Field

Example embodiments relate generally to semiconductor integrated circuits, and more particularly to an electroluminescent display device and a method of compensating luminance in the electroluminescent display device.

2. Discussion of the Related Art

As information technology is developed, a display device becomes important to provide information to a user. Various display devices such as liquid crystal displays (LCDs), plasma displays, and electroluminescent displays have gained popularity. Among these, electroluminescent displays have quick response speeds and reduced power consumption, using light-emitting diodes (LEDs) or organic light-emitting diodes (OLEDs) that emit light through recombination of electrons and holes.

The electroluminescent display has advantages of rapid response and low power consumption. The typical OLED display device supplies a current corresponding to a data signal using driving transistors of respective pixels to generate lights through the OLEDs of the respective pixels. As such, the electroluminescent display device displays an image using the current. The loading of a display panel of the electroluminescent display device may be changed depending on light emission ratios of color pixels, for example, a red pixel, a green pixel and a blue pixel, and/or depending on input image data. The luminance uniformity may be degraded according to the changes of the loading of the display panel.

SUMMARY

It is an aspect to provide a method of compensating luminance in an electroluminescent display device, capable of enhancing luminance uniformity.

It is another aspect to provide an electroluminescent display device having enhanced luminance uniformity.

According to an aspect of one or more example embodiments, there is provided a method of compensating luminance in an electroluminescent display device including a display panel including a plurality of pixels. The method includes generating a global current value based on a plurality of input pixel values corresponding to the plurality of pixels, the global current value indicating a global current flowing through the display panel, with respect to each of the plurality of input pixel values, generating a global compensation value indicating a global luminance deviation according the global current based on the input pixel value and the global current value, generating a gamma compensation value indicating a gamma distortion based on the input pixel value, the gamma distortion being caused by compensating the input pixel value and generating a compensated pixel value based on the input pixel value, the global compensation value and the gamma compensation value.

According to another aspect of one or more example embodiments, there is provided a method of generating a compensated pixel value for compensating luminance in an electroluminescent display device including a display panel including a plurality of pixels. The method includes generating a global current value based on a plurality of input pixel values corresponding to the plurality of pixels, the global current value indicating a global current flowing through the display panel, providing a global luminance deviation table including a plurality of global compensation values corresponding to different combinations of a plurality of pixels values and a plurality of global current values, with respect to each of the plurality of input pixel values, generating the global compensation value indicating a global luminance deviation according the global current using the global luminance deviation table, generating a gamma compensation value indicating a gamma distortion based on the input pixel value, the gamma distortion being caused by compensating the input pixel value, generating a local compensation value indicating a local luminance deviation according to a position of the pixel corresponding to the input pixel value, based on the input pixel value and the global current value and generating a compensated pixel value corresponding to a sum of the input pixel value, the global compensation value, the local compensation value and the gamma compensation value.

According to another aspect of one or more example embodiments, there is provided an electroluminescent display device including a display panel including a plurality of pixels and a luminance compensation circuit. The luminance compensation circuit, based on a plurality of input pixel values corresponding to the plurality of pixels, generates a global current value indicating a global current flowing through the display panel, generating a global compensation value indicating a global luminance deviation according to the global current with respect to each of the plurality of input pixel values, a local compensation value indicating a local luminance deviation according to a position of the pixel corresponding to the input pixel value, and a gamma compensation value indicating a gamma distortion caused by compensating the input pixel value, and generates a compensated pixel value based on the input pixel value, the global compensation value, the local compensation value and the gamma compensation value.

BRIEF DESCRIPTION OF THE DRAWINGS

Example embodiments will be more clearly understood from the following detailed description taken in conjunction with the accompanying drawings, in which:

FIG. 7 is a diagram illustrating an example embodiment of a global luminance deviation table applied to a luminance compensation circuit according to example embodiments;

FIGS. 12A through 13B are diagrams illustrating compensation of a voltage drop according to example embodiments;

DETAILED DESCRIPTION

Figure 1:
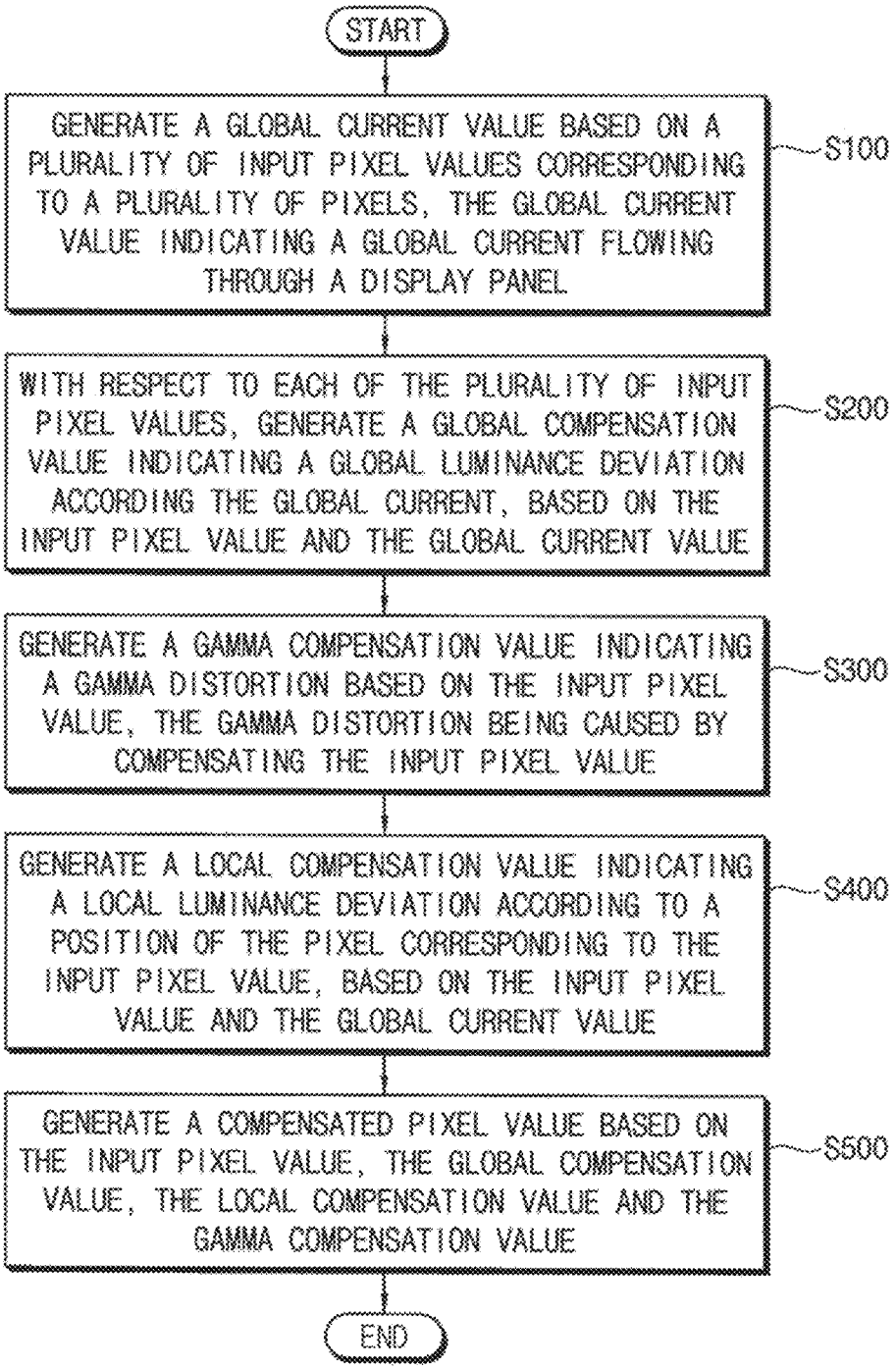
FIG. 1 is a flow chart illustrating a method of compensating luminance in an electroluminescent display device according to example embodiments.

Various example embodiments will be described more fully hereinafter with reference to the accompanying drawings, in which some example embodiments are shown. In the drawings, like numerals refer to like elements throughout. In the description that follows, repeated descriptions may be omitted for conciseness.

The electroluminescent display device and the method of compensating luminance according to example embodiments may enhance luminance uniformity significantly by compensating the input pixel values reflecting gamma distortion in addition to luminance deviation due the voltage drop of the display panel.

In addition, the electroluminescent display device and the method of compensating luminance according to example embodiments may enhance luminance uniformity by compensating the luminance deviation and the gamma distortion through a digital scheme based on the input pixel values better than an analog scheme based on measurement and control of current and/or voltage.

FIG. 1 is a flow chart illustrating a method of compensating luminance in an electroluminescent display device according to example embodiments.

FIG. 1 illustrates a method of compensating luminance in an electroluminescent display device including a display panel, which includes a plurality of pixels. Referring to FIG. 1, a global current value is generated based on a plurality of input pixel values corresponding to a plurality of pixels, where the global current value indicates a global current flowing through a display panel (S100).

In general, the display panel displays images per frame unit, and the global current value may be generated by units of frames. In other words, the plurality of input pixel values may be changed per frame, and thus the global current value may be updated per frame.

With respect to each of the plurality of input pixel values, a global compensation value indicating a global luminance deviation according the global current is generated based on the input pixel value and the global current value (S200).

The global luminance deviation may indicate a voltage drop (IR-drop, ohmic drop, etc.) or a loading effect generated by a current that is varied depending on an input image and a parasite resistance of wirings for supplying a power supply voltage to the display panel.

In some example embodiments, a global luminance deviation table including a plurality of global compensation values corresponding to different combinations of a plurality of pixels values and a plurality of global current values may be provided and the global compensation value may be generated using the global luminance deviation table. Example embodiments of generating the global current value and the global compensation value will be described below with reference to FIGS. 5A through 8.

A gamma compensation value indicating a gamma distortion is generated based on the input pixel value, the gamma distortion being caused by compensating the input pixel value (S300).

In some example embodiments, a gamma compensation table including a plurality of gamma compensation values corresponding to a plurality of pixel values may be provided and the gamma compensation value may be generated using the gamma compensation table. Example embodiments of generating the gamma compensation value will be described below with reference to FIGS. 14A through 15B.

A local compensation value indicating a local luminance deviation according to a position of the pixel corresponding to the input pixel value is generated, based on the input pixel value and the global current value (S400).

The local luminance deviation may indicate a luminance deviation according to the voltage drop that is changed depending on the pixel position in the display panel and the input pixel value. Example embodiments of generating the local compensation value will be described below with reference to FIGS. 9 through 11B.

A compensated pixel value is generated based on the input pixel value, the global compensation value, the local compensation value and the gamma compensation value (S500).

In some example embodiments, a sum of the input pixel value, the global compensation value, the local compensation value and the gamma compensation value may be provided as the compensated pixel value.

In other example embodiments, generating the local compensation value may be omitted. In this case, the local compensation value may be considered as zero, and thus a sum of the input pixel value, the global compensation value and the gamma compensation value may be provided as the compensated pixel value.

As such, the electroluminescent display device and the method of compensating luminance according to example embodiments may enhance luminance uniformity significantly by compensating the input pixel values reflecting gamma distortion in addition to luminance deviation due the voltage drop of the display panel. In addition, the electroluminescent display device and the method of compensating luminance according to example embodiments may enhance luminance uniformity by compensating the luminance deviation and the gamma distortion through a digital scheme based on the input pixel values better than an analog scheme based on measurement and control of current and/or voltage.

Figure 2A:
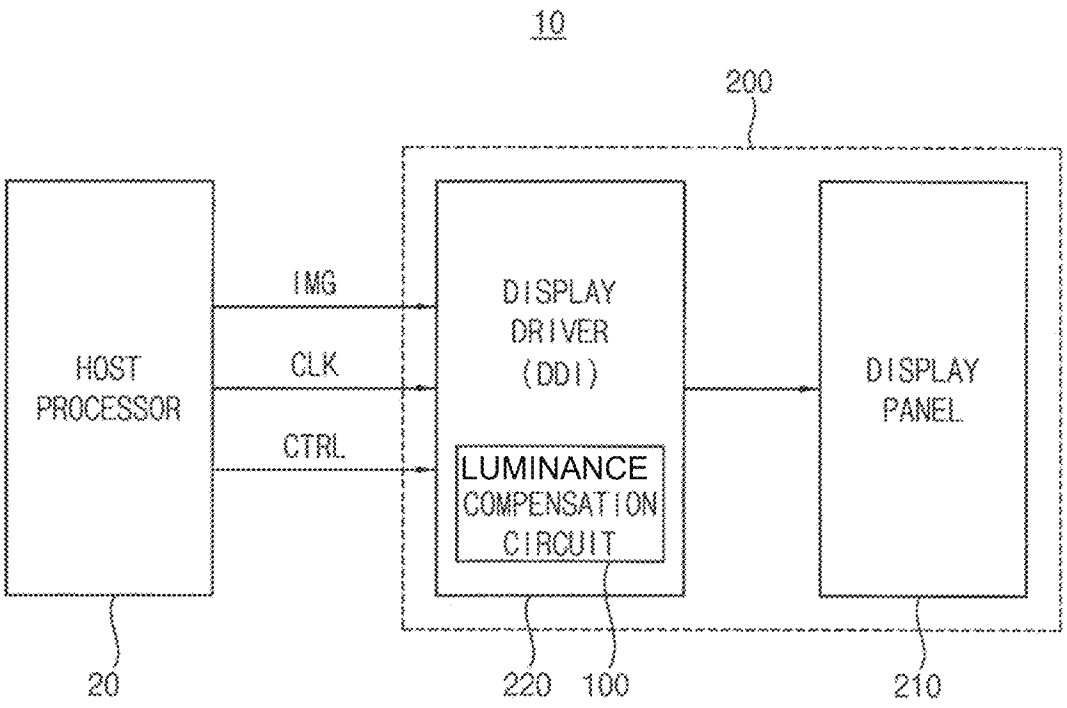
FIG. 2A is a block diagram illustrating a display system according to example embodiments.

FIG. 2A is a block diagram illustrating a display system according to example embodiments.

A display system 10 may be various electronic devices having a function of image display such as a mobile phone, a smartphone, a tablet personal computer (PC), a personal digital assistant (PDA), a wearable device, a potable multimedia player (PMP), a handheld device, a handheld computer, and so on.

Referring to FIG. 2A, the display system 10 may include a host processor 20 and a display device 200.

The host processor 20 may control overall operations of the display system 10. The host processor 10 may be an application processor (AP), a baseband processor (BBP), a micro-processing unit (MPU), and so on. The host processor 20 may provide input image data IMG a clock signal CLK and control signals CTRL to the display device 200. For example, the input image data IMG may include RGB pixel values and have a resolution of w*h where w is a number of pixels in a horizontal direction and h is a number of pixels in a vertical direction.

The control signals may include a command signal, a horizontal synchronization signal, a vertical synchronization signal, a data enable signal, and so on. For example, the input image data IMG and the control signals CTRL may be provided, as a form of a packet, to a display driver (DDI) 220 in the display device 200. The command signal may include control information, image information and/or display setting information. The control information may be used to control a luminance compensation circuit 100 in the display driver 220 to adjust the input image data IMG The image information may include, for example, a resolution of the input image data IMG The display setting information may include, for example, panel information, a luminance setting value, and so on. For example, the host processor 20 may provide, as the display setting information, information according to a user input or according to predetermined setting values.

The display driver 220 may drive the display panel 210 based on the input image data IMG and the control signals CTRL. The display driver 220 may convert the digital input image signal IMG to analog signals, and drive the display panel 210 based on the analog signals.

The display driver 220 includes the luminance compensation circuit 100. The luminance compensation circuit 100 may compensate pixel values of the input image data IMG so that the display driver 220 may drive the display panel 210 based on the compensated pixel values. As will be described below, the luminance compensation circuit 100 may be implemented to perform the luminance compensation method according to example embodiments.

Figure 2B:
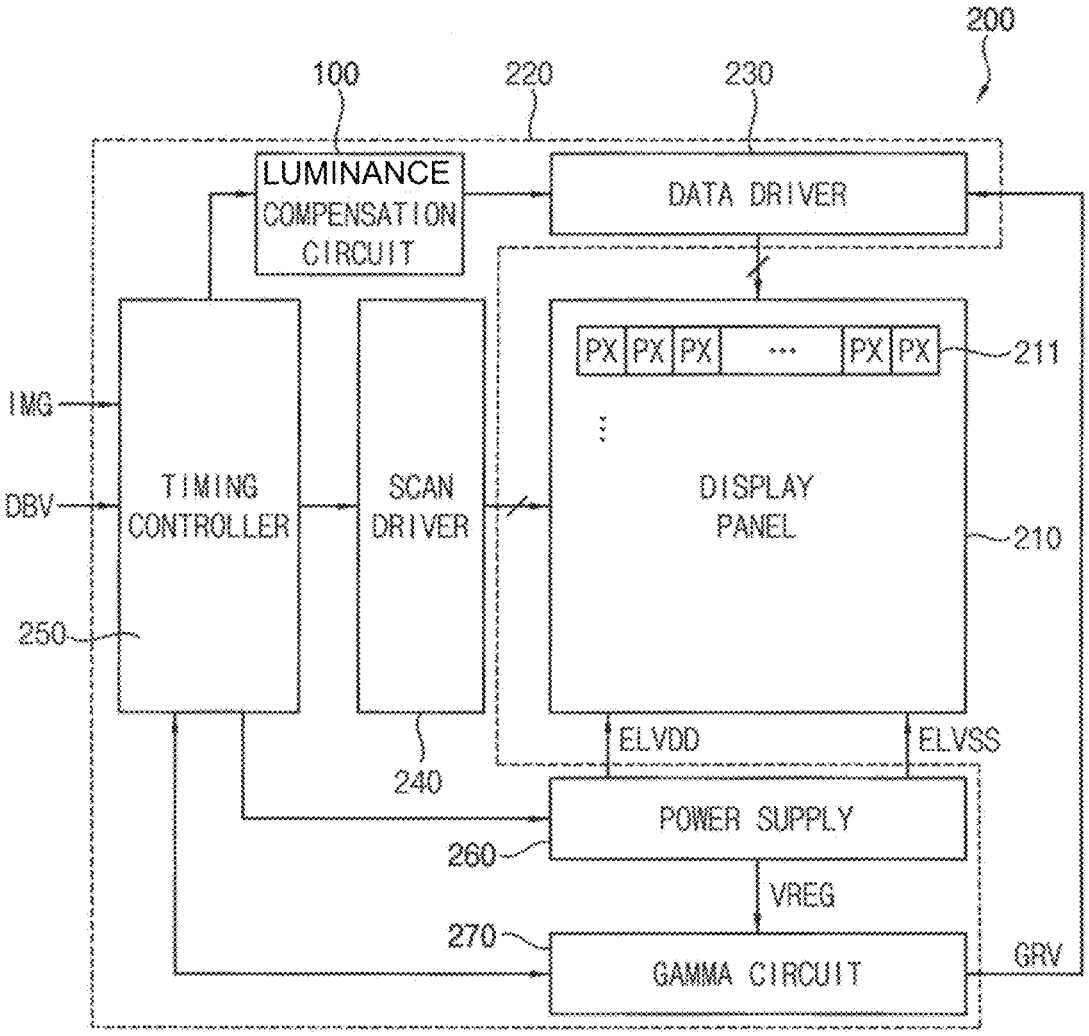
FIG. 2B is a block diagram illustrating an electroluminescent display device according to example embodiments.

FIG. 2B is a block diagram illustrating an electroluminescent display device according to example embodiments.

Referring to FIG. 2B, an electroluminescent display device 200 may include a display panel 210 including a plurality of pixel rows 211 and a display driver 220 that drives the display panel 210. The display driver 220 may include a data driver 230, a scan driver 240, a timing controller 250, a power supply 260, a luminance compensation circuit 100 and a gamma circuit 270.

The display panel 210 may be connected to the data driver 230 of the display driver 220 through a plurality of data lines and may be connected to the scan driver 240 of the display driver 220 through a plurality of scan lines. The display panel 210 may include the pixel rows 211. That is, the display panel 210 may include a plurality of pixels PX arranged in a matrix having a plurality of rows and a plurality of columns. One row of pixels PX connected to the same scan line may be referred to as one pixel row 211. In some example embodiments, the display panel 210 may be a self-emitting display panel that emits light without the use of a back light unit. For example, the display panel 210 may be an organic light-emitting diode (OLED) display panel.

Each pixel PX included in the display panel 210 may have various configurations according to a driving scheme of the display device 200. For example, the electroluminescent display device 200 may be driven with an analog or a digital driving method. While the analog driving method produces grayscale using variable voltage levels corresponding to input data, the digital driving method produces grayscale using variable time duration in which the LED emits light. The analog driving method is difficult to implement because the analog driving method uses a driving integrated circuit (IC) that is complicated to manufacture if the display is large and has high resolution. The digital driving method, on the other hand, may readily accomplish high resolution through a simpler IC structure. As the size of the display panel becomes larger and the resolution increases, the digital driving method may have more favorable characteristics over the analog driving method. The method of compensating luminance according to example embodiments may be applied to both of the analog driving method and the digital driving method.

The data driver 230 may apply a data signal to the display panel 210 through the data lines. The scan driver 240 may apply a scan signal to the display panel 210 through the scan lines.

The timing controller 250 may control the operation of the display device 200. The timing controller 250 may provide control signals to the data driver 230 and the scan driver 240 to control the operations of the display device 200. The control signals may be predetermined. In some example embodiments, the data driver 230, the scan driver 240 and the timing controller 250 may be implemented as one integrated circuit (IC). In other example embodiments, the data driver 230, the scan driver 240 and the timing controller 250 may be implemented as two or more integrated circuits. A driving module including at least the timing controller 250 and the data driver 230 may be referred to as a timing controller embedded data driver (TED).

The timing controller 250 may receive the input image data IMG and the input control signals from the host processor 20. For example, the input image data may include red (R) image data, green (G) image data and blue (B) image data. According to example embodiments, the input image data IMG may include white image data, magenta image data, yellow image data, cyan image data, and so on. In this disclosure, the input image data IMG is described using RGB data as an example, but the input image data IMG may include various color data other than the red, green and blue data. The input control signals may include a master clock signal, a data enable signal, a horizontal synchronization signal, a vertical synchronization signal, and so on.

The host processor 20 may provide a luminance setting value DBV indicating luminance information of the display panel 210 to the timing controller 250. The luminance setting value DBV may be determined automatically depending on the environmental luminance of the display device 200 or manually depending on the user input. The luminance setting value DBV may include dimming information that is determined according to the input image data IMG For example, the luminance setting value DBV may indicate a maximum luminance value of the display panel 210.

The power supply 260 may supply the display panel 210 with a high power supply voltage ELVDD and a low power supply voltage ELVSS. In addition, the power supply 260 may supply a regulator voltage VREG to the gamma circuit 270.

The gamma circuit 270 may generate gamma reference voltages GRV based on the regulator voltage VREG The luminance compensation circuit 100 may, based on a plurality of input pixel values corresponding to a plurality of pixels, generate a global current value indicating a global current flowing through a display panel, and generate a global compensation value indicating a global luminance deviation according the global current with respect to each of the plurality of input pixel values, and a gamma compensation value indicating a gamma distortion caused by compensating the input pixel value. In addition, the luminance compensation circuit 100 may generate a compensated pixel value based on the input pixel value, the global compensation value and the gamma compensation value.

In some example embodiments, the luminance compensation circuit 100 may further generate a local compensation value indicating a local luminance deviation according to a position of the pixel corresponding to the input pixel value. In this case, the luminance compensation circuit 100 may generate the compensated pixel value based on the local compensation value in addition to the input pixel value, the global compensation value and the gamma compensation value.

Figure 3:
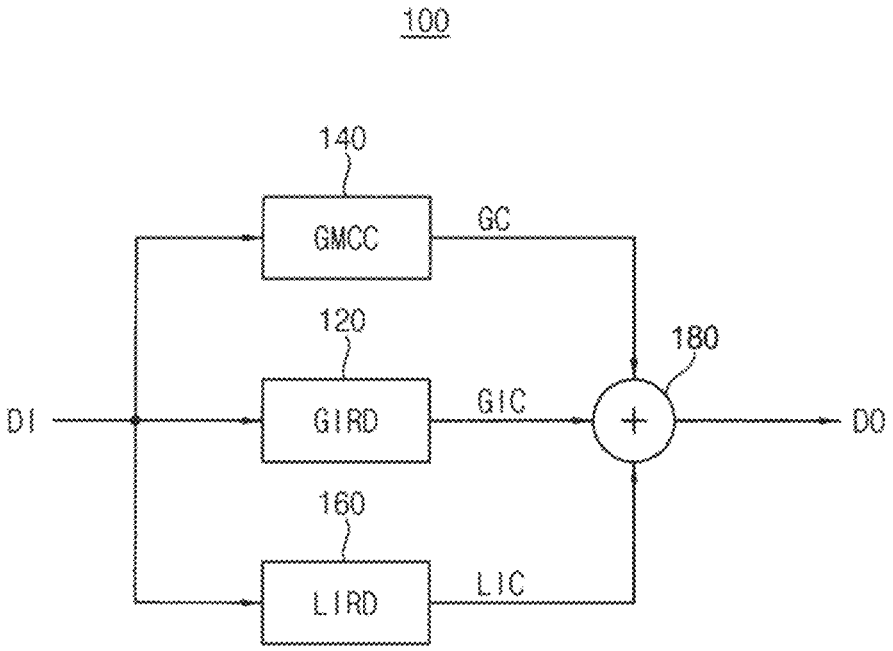
FIG. 3 illustrates an example of a luminance compensation circuit according to example embodiments.

FIG. 3 illustrates an example of a luminance compensation circuit according to example embodiments.

Referring to FIG. 3, a luminance compensation circuit 100 may include a global compensation circuit (GIRD) 120, a gamma compensation circuit (GMCC) 140 and a local compensation circuit (LIRD) and an adder 180.

The luminance compensation circuit 100 may perform the luminance compensation method according to example embodiments with respect to input image data DI to output compensated image data DO. The input image data DI may be provided by units of frames and each frame of the input image data DI may include a plurality of input pixel values corresponding to a plurality of pixels included in the display panel. The compensated image data DO may include a plurality of compensated pixel values corresponding to the plurality of input pixel values.

The global compensation circuit (GIRD) 120 may generate a global current value based on the plurality of input pixel values corresponding to the plurality of pixels where the global current value indicates a global current flowing through the display panel. The global compensation circuit 120 may generate and provide, with respect to each of the plurality of input pixel values, a global compensation value (GIC) indicating a global luminance deviation according the global current based on the input pixel value and the global current value.

In general, the display panel displays images per frame unit, and the global current value may be generated by units of frames. In other words, the plurality of input pixel values may be changed per frame, and thus the global current value may be updated per frame. The global luminance deviation may indicate a voltage drop (IR-drop, ohmic drop, etc.) or a loading effect generated by a current that is varied depending on an input image and a parasite resistance of wirings for supplying a power supply voltage to the display panel.

The local compensation circuit (LIRD) 160 may generate a local compensation value (LIC) indicating a local luminance deviation according to a position of the pixel corresponding to the input pixel value, based on the input pixel value and the global current value. The local luminance deviation may indicate a luminance deviation according to the voltage drop that is changed depending on the pixel position in the display panel and the input pixel value.

The gamma compensation circuit (GMCC) 140 may generate a gamma compensation value (GC) indicating a gamma distortion based on the input pixel value, the gamma distortion being caused by compensating the input pixel value.

The adder 180 may generate the compensated pixel value corresponding to a sum of the input pixel value, the global compensation value, the local compensation value and the gamma compensation value. Each compensated pixel value corresponds to each input pixel value. In other words, the luminance compensation circuit 100 may provide the compensated image data DO including the plurality of compensated pixel values corresponding to the plurality of input pixel values included in the input image data DI.

In some example embodiments, the local compensation circuit (LIRD) 160 may be omitted. In this case, the adder 180 may generate the compensated pixel value corresponding to a sum of the input pixel value, the global compensation value and the gamma compensation value.

As such, the electroluminescent display device and the method of compensating luminance according to example embodiments may enhance luminance uniformity significantly by compensating the input pixel values reflecting gamma distortion in addition to luminance deviation due the voltage drop of the display panel. In addition, the electroluminescent display device and the method of compensating luminance according to example embodiments may enhance luminance uniformity by compensating the luminance deviation and the gamma distortion through a digital scheme based on the input pixel values better than an analog scheme based on measurement and control of current and/or voltage.

Figure 4A:
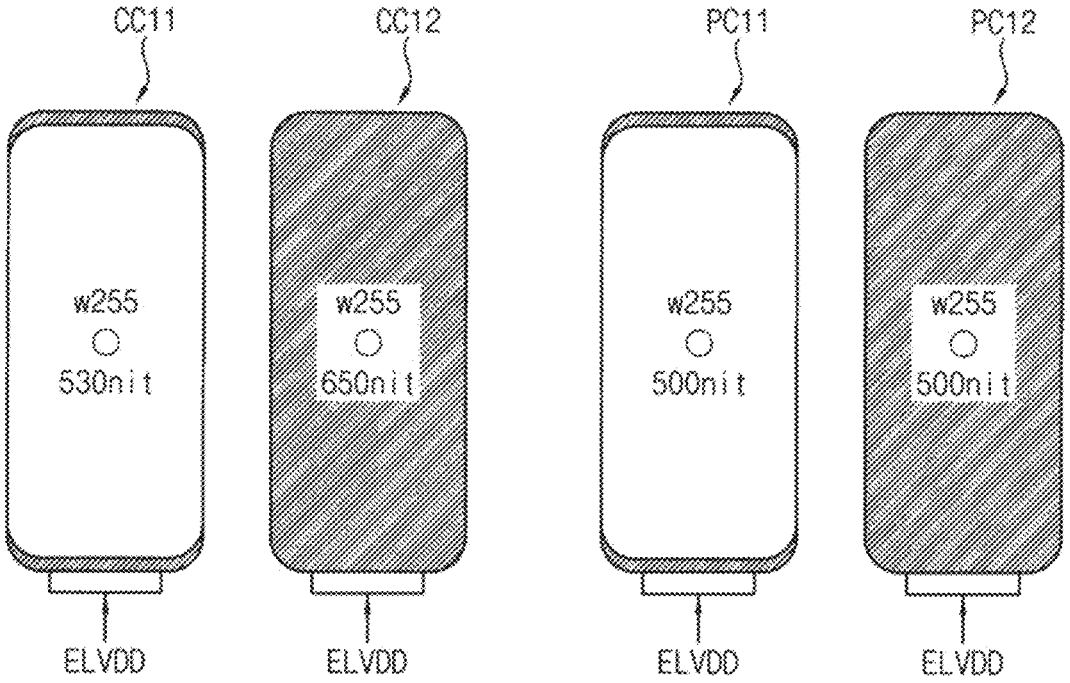
FIGS. 4A, 4B and 4C are diagrams for describing enhancement of luminance uniformity according to example embodiments.
Figure 4B:
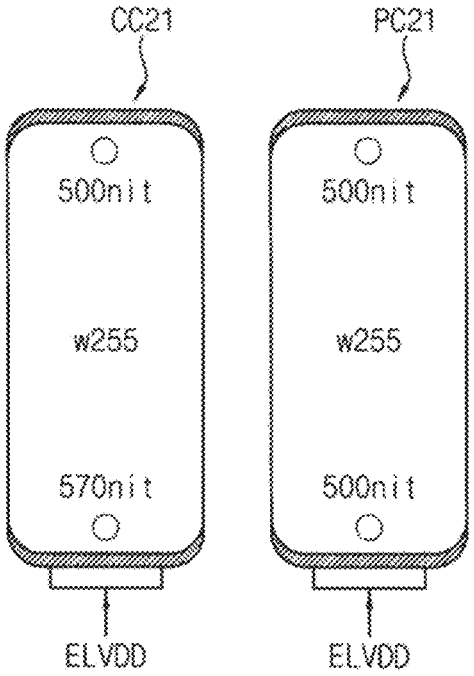
Figure 4C:
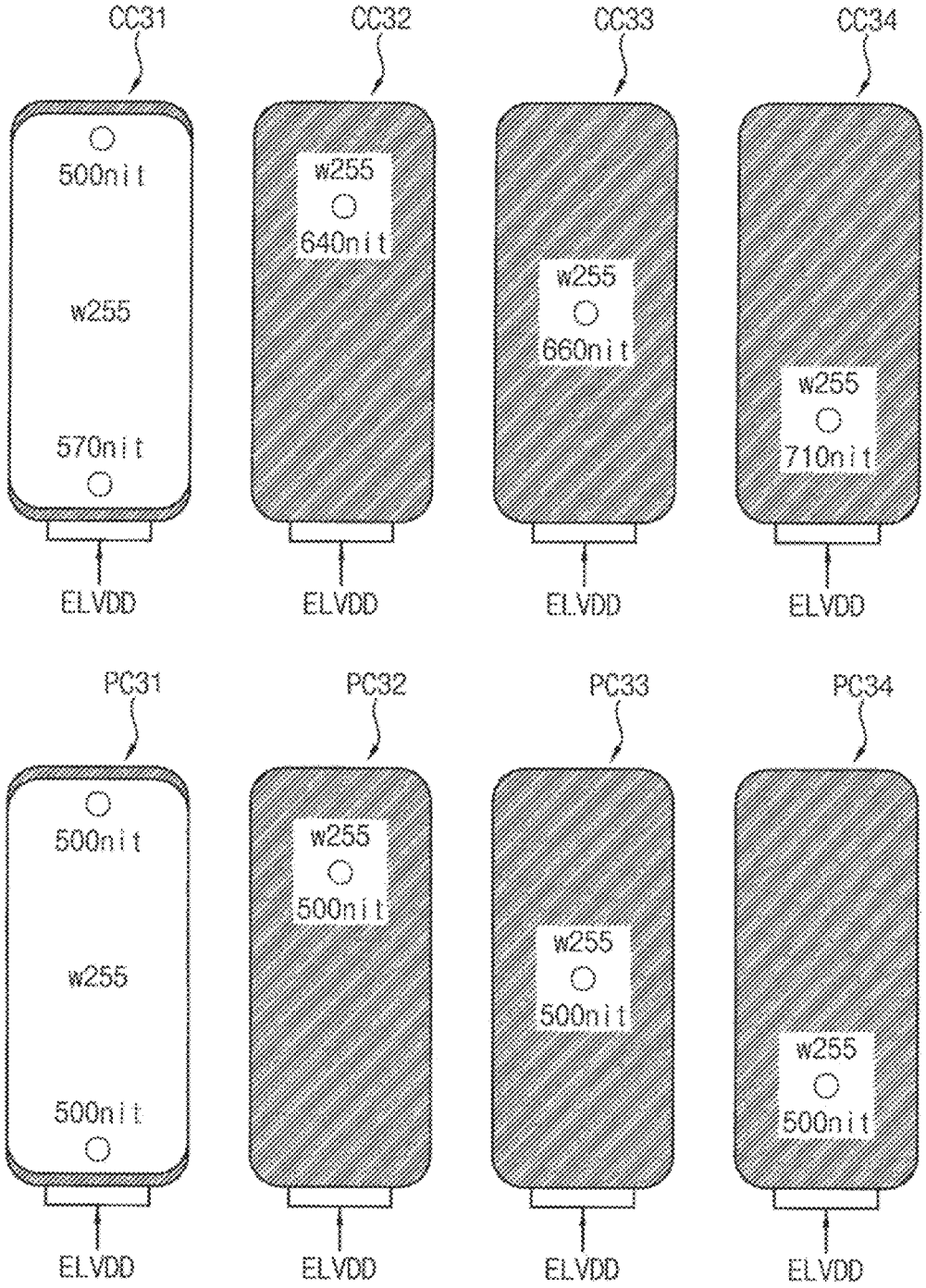

FIGS. 4A, 4B and 4C are diagrams for describing enhancement of luminance uniformity according to example embodiments.

In FIGS. 4A, 4B and 4C, "nit" denotes a luminance unit, that is, cd/m$^2$, and "w255" denotes a maximum pixel value, for example, when each pixel value is represented by eight bits. The maximum pixel value may be changed depending on the bit number of the pixel value.

If an IR-drop occurs in the electroluminescent display device, two kinds of luminance deviation may be caused. Firstly, as illustrated in CC11 and CC12 of FIG. 4A, even though the same input pixel value is input, the output luminance may be different when the other pixel values are different. That is, for example, the same input pixel value is input in CC11 and CC12, but in CC11 the output luminance is 530 nit, whereas in CC12 the output luminance is 650 nit. Secondly, as illustrated in CC21 of FIG. 4B, even though a monochromatic image is input, the output luminance may be different according to the positions of the display panel. That is, for example, in CC21 a monochromatic image is input, but the output luminance at the top of the display is 500 nit, whereas the output luminance at the bottom of the display is 570 nit.

When the above two effects are mixed, the output luminance may be different according to both of the input image and the positions of the display panel, as illustrated in CC31, CC32, CC33 and CC43 in FIG. 4C.

According to example embodiments, the amount of the voltage drop may be anticipated using the input image data and the luminance setting value. The luminance uniformity may be enhanced by compensating the input image data and the gamma distortion based on the result of the anticipation.

As a result, the luminance deviation varying depending on the input image data may be reduced significantly and the uniform image may be displayed as illustrated in PC11 and PC 12 of FIG. 4A, PC21 of FIG. 4B, and PC31, PC32, PC33 and PC34 of FIG. 4C.

Figure 5A:
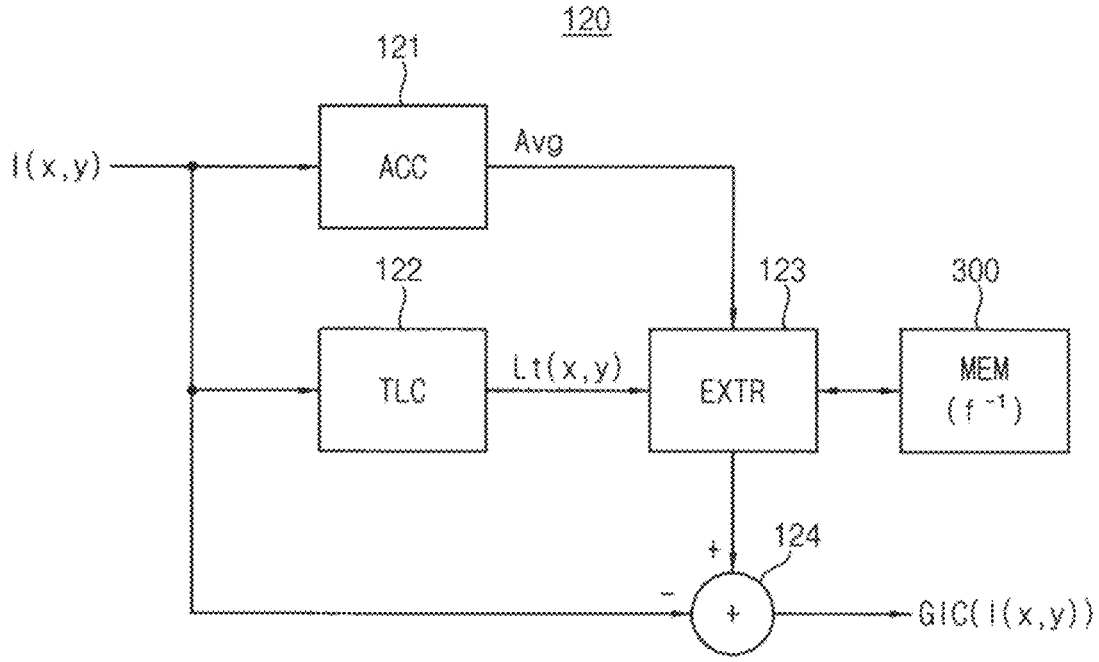
FIGS. 5A, 5B and 5C are block diagrams illustrating example embodiments of a global compensation circuit included in the luminance compensation circuit of FIG. 3.
Figure 5B:
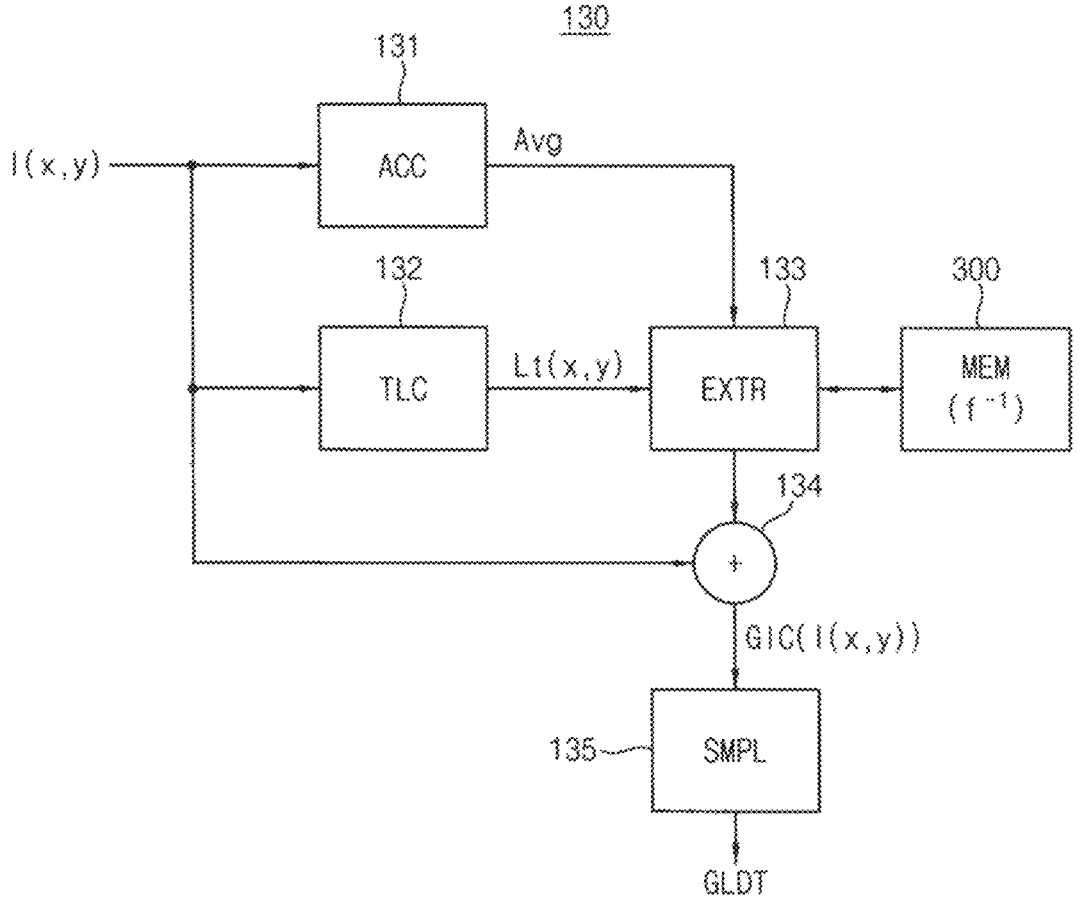
Figure 5C:
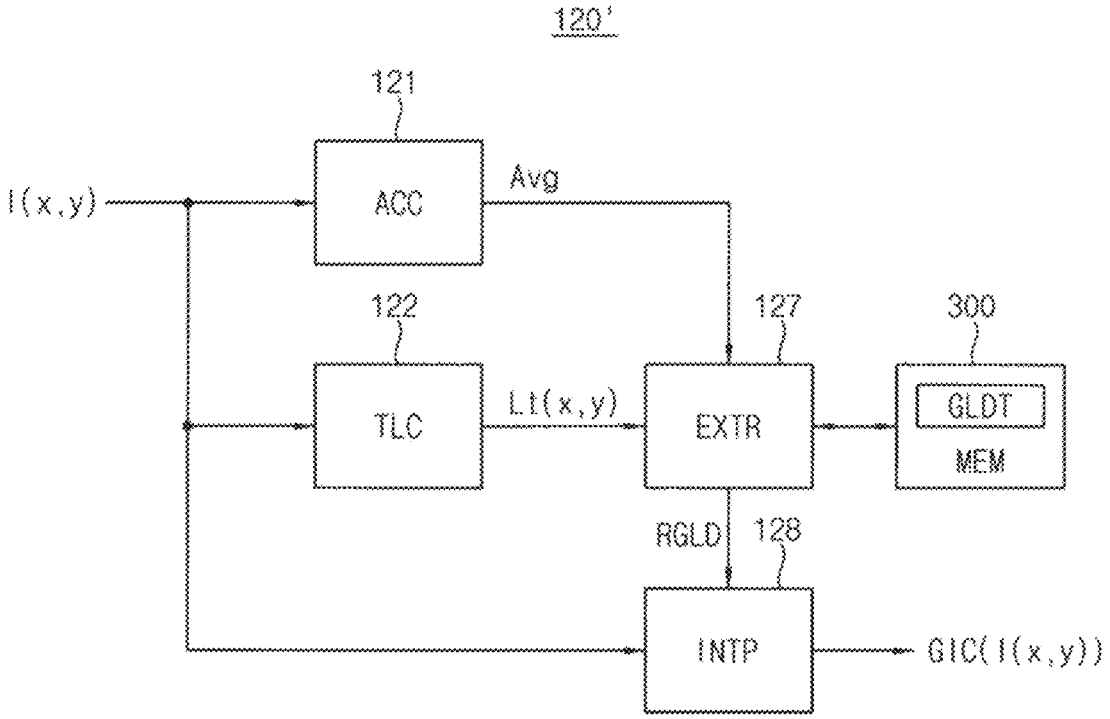
Figure 6A:
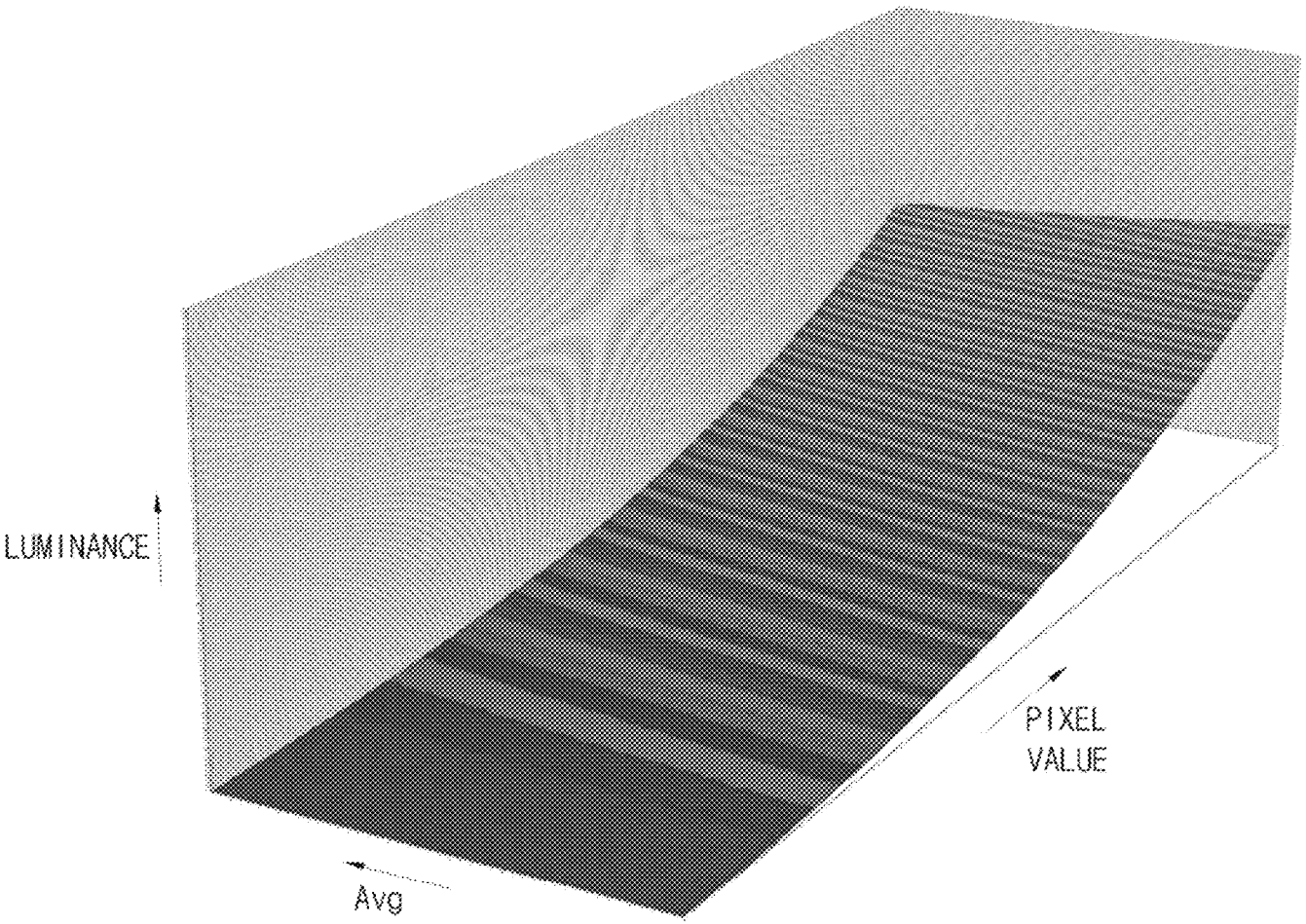
FIG. 6A is diagram illustrating a relationship of a pixel value, a global current value and luminance.
Figure 6B:
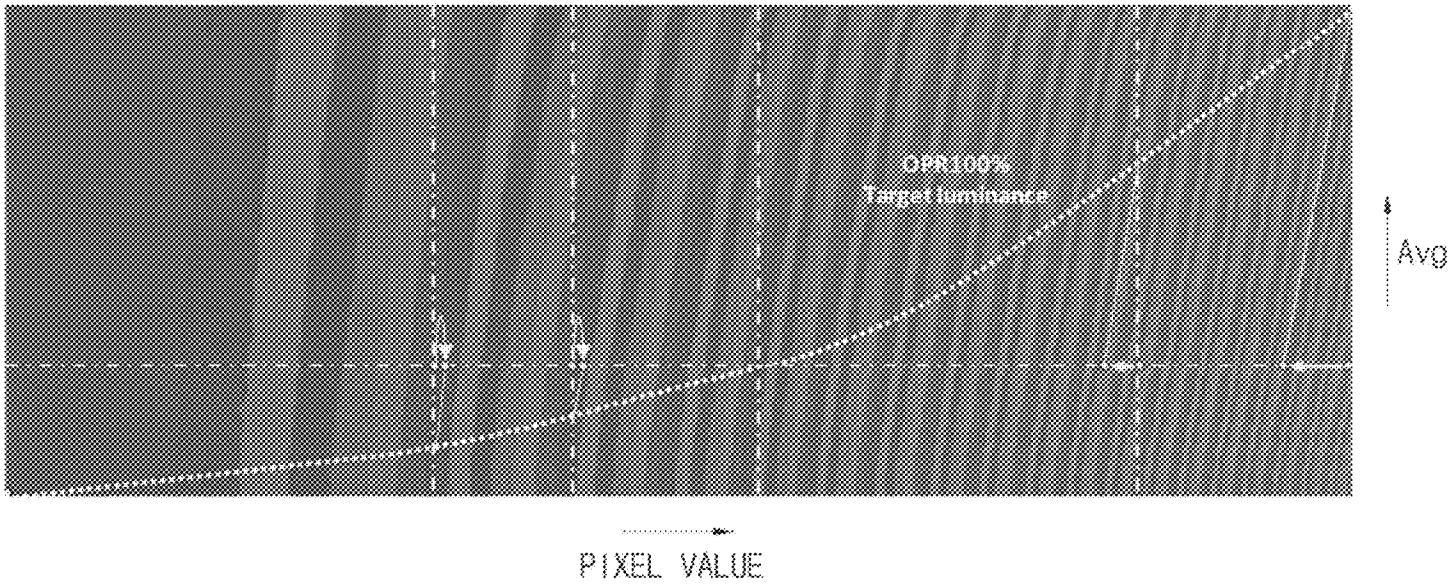
FIG. 6B is a diagram for describing a global compensation value of a method of compensating luminance according to example embodiments.

FIGS. 5A, 5B and 5C are block diagrams illustrating example embodiments of a global compensation circuit included in the luminance compensation circuit of FIG. 3, FIG. 6A is diagram illustrating a relationship of a pixel value, a global current value and luminance, FIG. 6B is a diagram for describing a global compensation value of a method of compensating luminance according to example embodiments, and FIG. 7 is a diagram illustrating an example embodiment of a global luminance deviation table applied to a luminance compensation circuit according to example embodiments.

Referring to FIG. 5A, the global compensation circuit 120 may include a global current calculation circuit (ACC) 121, a target luminance calculation circuit (TLC) 122, an extractor (EXTR) 123 and a calculator 124. A memory (MEM) 300 illustrated in FIG. 5A may be a dedicated memory of the luminance compensation circuit 100, or a memory outside the luminance compensation circuit 100 to be shared by the electroluminescent display device 200.

The global current calculation circuit (ACC) 121 may generate the global current value Avg based on the plurality of input pixel values I(x,y) corresponding to the plurality of pixels such that the global current value Avg may indicate the global current flowing through the display panel. Here, (x,y) denotes x and y coordinates, that is, the position of the pixel in the display panel.

The global voltage drop (IR-drop) shows characteristics of increasing in proportional to the global current flowing through the entire display panel. Accordingly, the global current may be anticipated for determining the global voltage drop. In some example embodiments, the global current value Avg indicating the global current may be determined by Expression 1.

$$Avg=Kn*\Sigma x,y\{Wr*Ir(x,y)^G+Wg*Ig(x,y)^G+Wb*Ib(x,y)^G\} \quad \text{Expression 1}$$

In Expression 1, (x,y) denotes coordinates of a pixel, Ir(x,y), Ig(x,y), and Ib(x,y) denote input pixel values according to the colors (r denotes a red color, g denotes a green color and b denotes a blue color) of the pixels, Wr, Wg and Wb denote current ratios according to the colors (r denotes a red color, g denotes a green color and b denotes a blue color) of the pixels, and G denotes a gamma value. For example, in some embodiments, the gamma value G may be set to be 2.2. Kn denotes a normalization constant to adjust the global current value Avg to a proper scale. Σx,y denotes summation for all pixels of each frame. The current ratios Wr, Wg and Wb may be determined depending on the characteristics of the electroluminescent display device.

As such, the global current value Avg may be provided based on a sum of respective multiplied values of the plurality of input pixel values, that is, the gamma-reflected values $Ir(x,y)^G$, $Ig(x,y)^G$, $IB(x,y)^G$, and the current ratios Wr, Wg and Wb of colors of the plurality of pixels.

The luminance deviation according to the global voltage drop may be represented by a luminance function of the global current value Avg and the input pixel value I(x,y) as Expression 2.

$$Lout(x,y)=f(I(x,y),Avg) \quad \text{Expression 2}$$

In Expression 2, f denotes the luminance function, I(x,y) denotes each input pixel value, Lout(x,y) denotes a luminance corresponding to a combination of each input pixel value I(x,y) and the global current value Avg. I(x,y) may be Ir(x,y), Ig(x,y) or Ib(x,y) according to the pixel color.

FIG. 6A illustrates an example of the luminance function. The luminance function of FIG. 6A indicates luminance values corresponding to combinations of a plurality of pixel values and a plurality of global current values. The global compensation value CIG(I(x,y)) corresponding to each input pixel value I(x,y) may be generated using an inverse function of the luminance function as illustrated in FIG. 6A.

The global compensation value (GIC) corresponding to the global voltage drop may be determined as Expression 3 and Expression 4 using the inverse function of the luminance function of Expression 2.

$$GIC(I(x,y))=f^{-1}(Lt(x,y),Avg)-I(x,y) \quad \text{Expression 3}$$

$$Lt(x,y)=Lmax*\{I(x,y)/Imax\}^G \quad \text{Expression 4}$$

In Expression 3 and Expression 4, (x,y) denotes coordinates of a pixel, GIC(I(x,y)) denotes the global compensation value corresponding to the pixel, $f^{-1}$ denotes the inverse function of the luminance function, Lt(x,y) denotes the target luminance value corresponding to the pixel, Avg denotes the global current value, I(x,y) denotes the input pixel value corresponding to the pixel, Lmax denotes a maximum luminance value, Imax denotes a maximum input pixel value and G denotes a gamma value.

For example, in case of the input pixel value of eight bits, Lmax denotes the luminance when all of the input pixel values are Imax=255.

The target luminance calculation circuit (TLC) 122 may generate the target luminance value Lt(x,y) corresponding to each input pixel value I(x,y) as in Expression 4.

GIC(x,y) may be determined through Expression 3 and Expression 4, and FIG. 6B illustrates an example method of determining GIC(x,y). FIG. 6B illustrates an example case when the on pixel ratio is 100%. The arrows in FIG. 6B indicate the amount of the global compensation value with respect to the several pixel values corresponding to the dotted vertical lines in FIG. 6B when then global current value corresponds to the dotted horizontal line in FIG. 6B.

In some example embodiments, the memory (MEM) 300 in FIG. 5A may store the inverse function $f^{-1}$ of the luminance function and the extractor 123 may calculate an inverse function value $f^{-1}$(Lt(x,y), Avg) corresponding to the target luminance value Lt(x,y) and the global current value Avg using the inverse function $f^{-1}$. The calculator 124 may subtract the input pixel value I(x,y) from the inverse function value $f^{-1}$(Lt(x,y), Avg) to generate the global compensation value GIG(x,y).

In some example embodiments, to implement hardware for providing the global compensation value GIC(x,y), a global luminance deviation table GLDT may be provided using a global compensation pre-processing circuit 130 as illustrated in FIG. 5B. The global luminance deviation table GLDT may be determined before a product is provided to a user or during an initial stage after the product is provided to the user.

Referring to FIG. 5B, the global compensation pre-processing circuit 130 may provide a plurality of global compensation values GIC(x,y) that are calculated using a global current calculation circuit (ACC) 131, a target luminance calculation circuit (TLC) 132, an extractor (EXTR) 133 and a calculator 134 as described with reference to FIG. 5A. A sample extractor (SMPL) 135 may provide a proper number of samples among the provided plurality of global compensation values GIC(x,y) to provide the global luminance deviation table GLDT of a reduced size, and thus the size of the memory storing the global luminance deviation table GLDT may be provided to correspond to this reduced size.

As illustrated in FIG. 5C, the memory (MEM) 300 may store the pre-calculated global luminance deviation table GLDT. FIG. 7 illustrates an example of the global luminance deviation table GLDT.

According to example embodiments, the global current value Avg may be normalized such that a maximum value of the global current value Avg corresponds to a maximum pixel value of the plurality of input pixel values. For example, as illustrated in FIG. 7, the global current value Avg may be normalized such that the maximum value of the global current value Avg and the maximum value of the input pixel value may be equal to 255 in case of the pixel value of eight bits. The normalization may be implemented by properly adjusting the normalization constant Kn in Expression 1.

For example, the global compensation value GIC(I(x,y)) may be determined by Expression 5.

$$GIC(I(x,y))=Wgic_dbv*Intp\{GLDT(I(x,y),Avg\} \quad \text{Expression 5}$$

In Expression 5, GLDT denotes the global luminance deviation table, Wgic_dbv denotes a weight parameter. The weight parameter Wgic_dbv may be varied depending on the luminance setting value DBV. For example, the weight parameter Wgic_dbv may be determined experimentally. The global compensation values GIC(I(x,y)) may be implemented by the sampled lookup table as illustrated in FIG. 7, the intermediate values between the sampled values may be calculated by the interpolating operation Intp{GLDT(I(x,y), Avg}.

Referring to FIG. 5C, an extractor (EXTR) 127 may extract reference global compensation values RGLD adjacent to the input pixel value I(x,y) and the global current value Avg from the global luminance deviation table GLDT. An interpolator (INTP) 128 may generate the global compensation value GIC(x,y) corresponding to a combination of the input pixel value I(x,y) and the global current value Avg by performing an interpolation operation with respect to the reference global compensation values RGLD.

Figure 8:
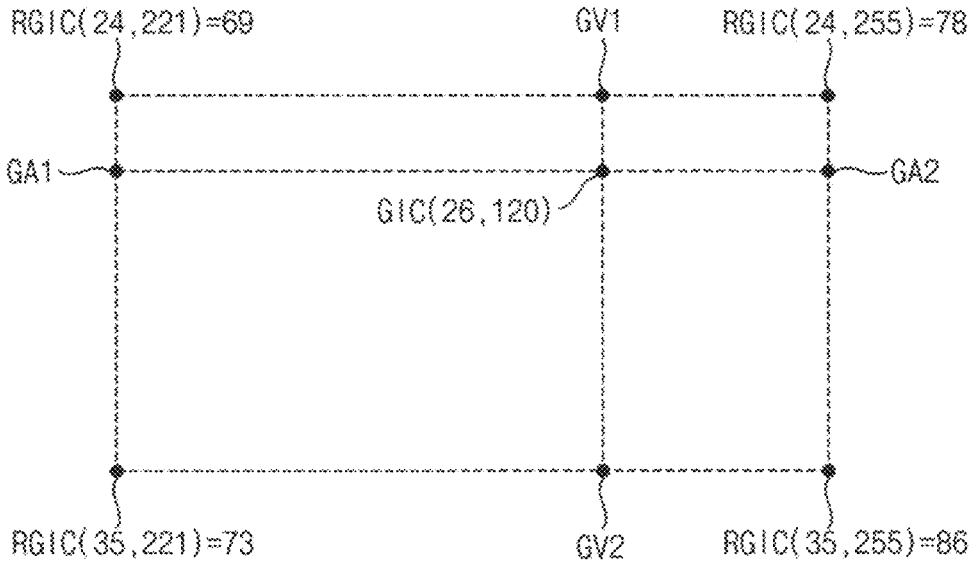
FIG. 8 is a diagram for describing an interpolation operation of the global compensation circuit of FIG. 5C.

FIG. 8 is a diagram for describing an interpolation operation of the global compensation circuit of FIG. 5C.

FIG. 8 shows an example interpolation operation of determining a global compensation value GIC(26, 120) corresponding to a combination of the input pixel value I(x,y)=26 and the global current value Avg=120.

The extractor (EXTR) 127 may extract a first reference global compensation value RGIC(24, 221)=69, a second reference global compensation value RGIC(24, 255)=78, a third reference global compensation value RGIC(35, 221)=73 and a fourth reference global compensation value RGIC(35,255)=86 from the global luminance deviation table GLDT of FIG. 7 to provide the extracted values to the interpolator (INTP) 128.

The interpolator (INTP) 128 may calculate a first value GV1 through an interval division of the first reference global compensation value RGIC(24, 221)=69 and a second reference global compensation value RGIC(24, 255)=78, and calculate a second value GV2 through an internal division of the third reference global compensation value RGIC(35, 221)=73 and the fourth reference global compensation value RGIC(35,255)=86. The interpolator (INTP) 128 then may calculate the final global compensation value GIC(26, 120) through an internal division of the first value GV1 and the second value GV2.

Alternatively, in a similar way, the interpolator (INTP) 128 may calculate a third value GA1 through an interval division of the first reference global compensation value RGIC(24, 221)=69 and the third reference global compensation value RGIC(35, 221)=73, and calculate a fourth value GA2 through an internal division of the second reference global compensation value RGIC(24, 255)=78 and the fourth reference global compensation value RGIC(35,255) =86. The interpolator (INTP) 128 then may calculate the final global compensation value GIC(26, 120) through an internal division of the third value GA1 and the fourth value GA2.

Expression 6 may be used to compensate both of the global voltage drop and the local voltage drop.

$$O(x,y)=I(x,y)+GC(I(x,y))+GIC(I(x,y))+LIC(x,y) \quad \text{Expression 6}$$

In Expression 6, (x,y) denotes coordinates of a pixel, O(x,y) denotes the compensated pixel value corresponding to the pixel, I(x,y) denotes the input pixel value corresponding to the pixel, GC(I(x,y)) denotes the gamma compensation value corresponding to the pixel, GIC(I(x,y)) denotes the global compensation value corresponding to the pixel, LIC(x,y) denotes the local compensation value corresponding to the pixel, Expression 6-1 may be used to compensate only the global voltage drop (i.e., and exclude the local voltage drop).

$$O(x,y)=I(x,y)+GC(I(x,y))+GIC(I(x,y)) \quad \text{Expression 6-1}$$

Figure 9:
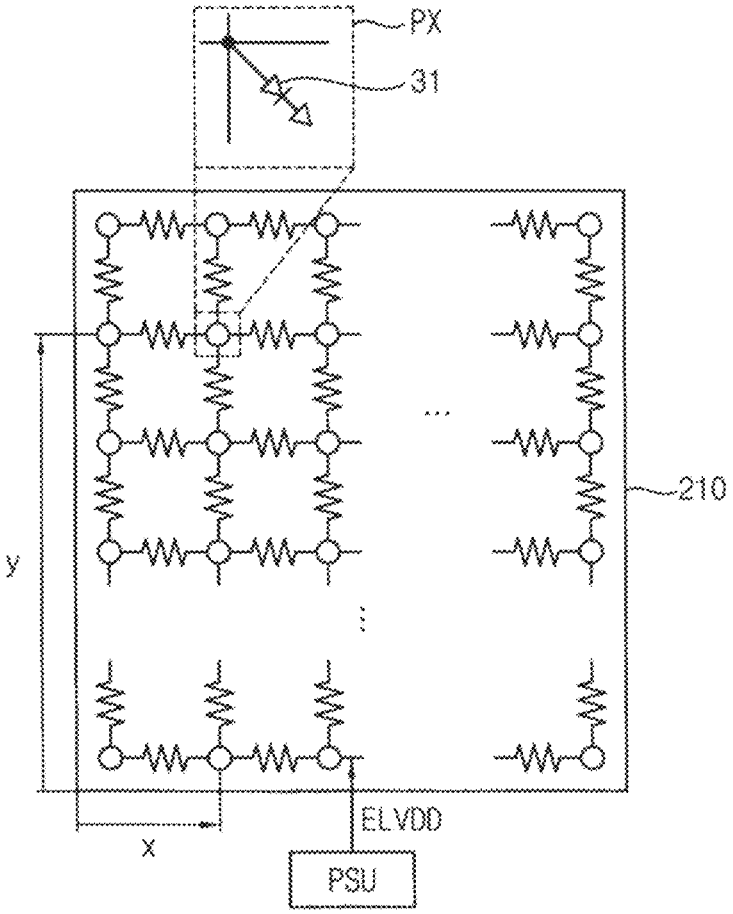
FIG. 9 is a diagram for describing a voltage drop of a display panel.

FIG. 9 is a diagram for describing a voltage drop of a display panel.

Referring to FIG. 9, a display panel 210 may include a mesh of resistors or parasitic resistors. The display panel 210 may include a plurality of pixels PX arranged in rows and columns. Each pixel PX may include an LED 31. For example, in each pixel PX, the light amount output from the LED 31 may be varied depending on the driving voltage or the power supply voltage ELVDD.

The power supply voltage ELVDD applied to the display panel 210 may be provided to the pixels PX through wirings of a mesh structure, and the voltage drop may be caused by the resistance of the wirings from the power supply PSU to each pixel PX. The position of the power supply PSU is not limited to that illustrated in FIG. 9 and may be determined variously.

The power supply voltage ELVDD may be provided to the display panel 210 through a uni-directional wiring and then to each pixel PX at each position (x,y) by a meshed grid structure inside the display panel 210. The voltage drop due to the uni-directional wiring may be referred to as the global voltage drop, which causes the luminance deviation as illustrated in CC11 and CC12 in FIG. 4A. The voltage drop due to the meshed grid structure may be referred to as the local voltage drop, which causes the luminance deviation as illustrated in CC21 in FIG. 4B.

Figure 10:
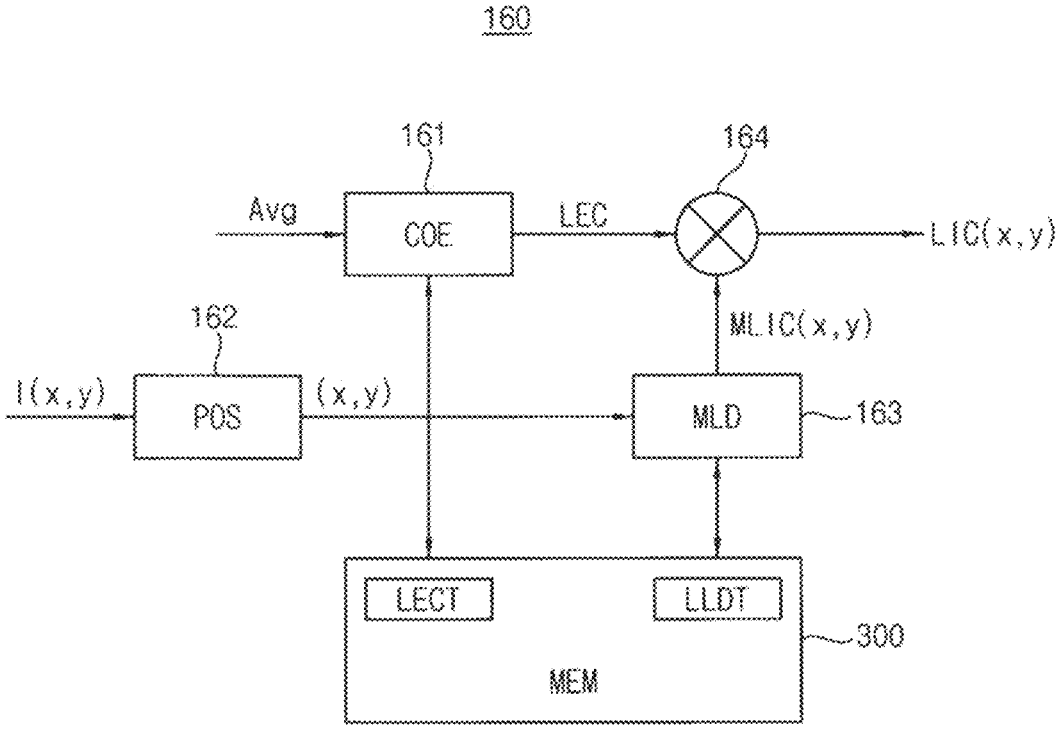
FIG. 10 is a block diagram illustrating an example embodiment of a local compensation circuit included in the luminance compensation circuit of FIG. 3.
Figure 11A:
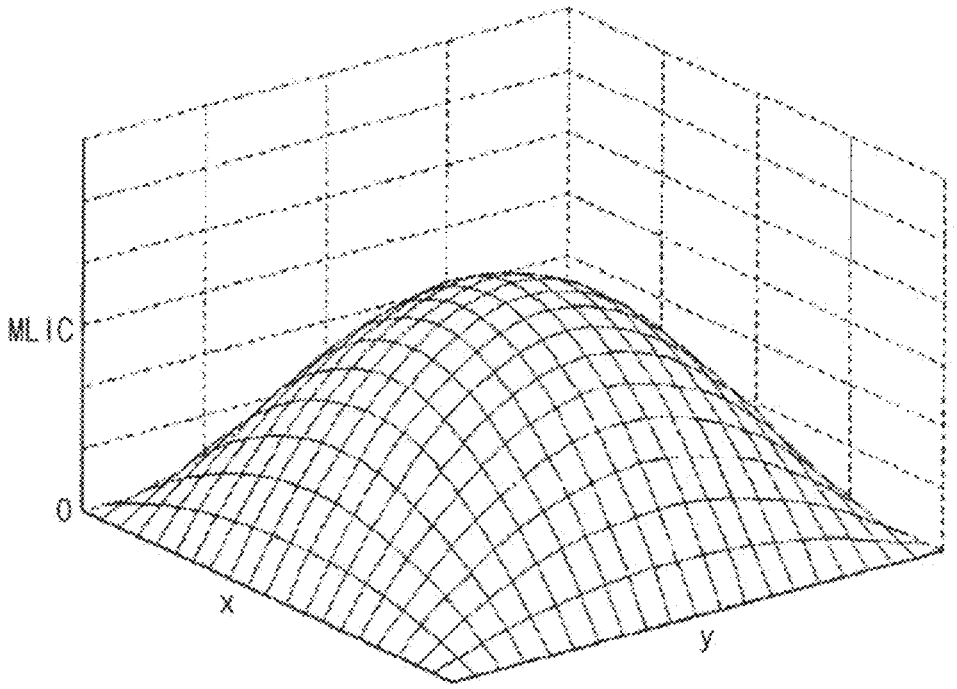
FIG. 11A is a diagram illustrating a relationship between a pixel position and a maximum local compensation value.
Figure 11B:
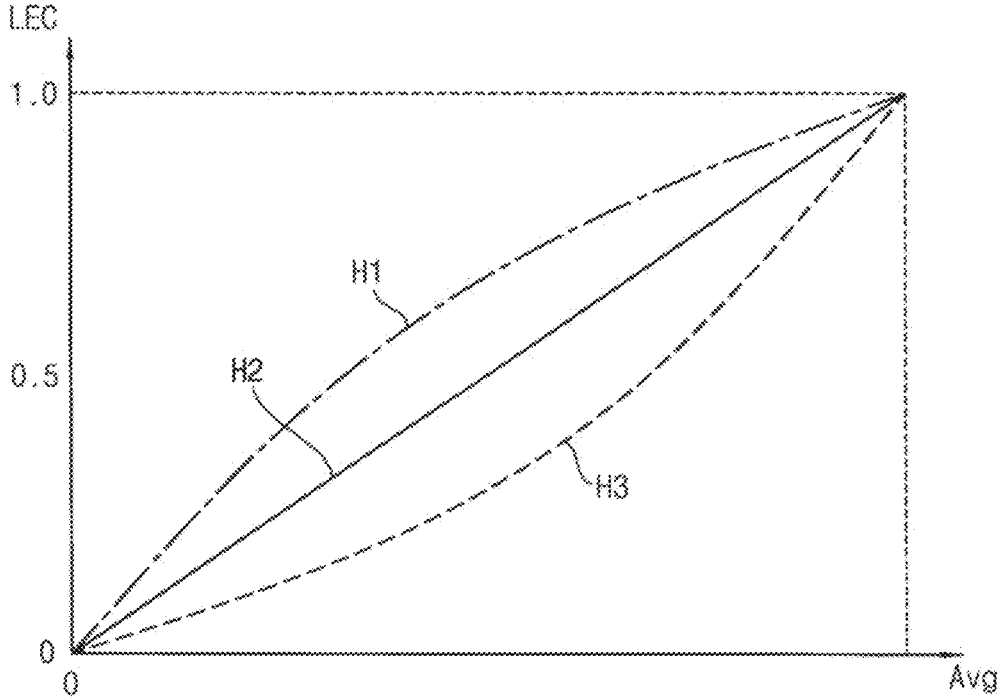
FIG. 11B is a diagram illustrating a relationship between a global current value and a proportional coefficient.

FIG. 10 is a block diagram illustrating an example embodiment of a local compensation circuit included in the luminance compensation circuit of FIG. 3, FIG. 11A is a diagram illustrating a relationship between a pixel position and a maximum local compensation value, and FIG. 11B is a diagram illustrating a relationship between a global current value and a proportional coefficient.

Referring to FIG. 10, a local compensation circuit (LIRD) 160 may include a coefficient generator (COE) 161, a position tracer (POS) 162, a maximum local compensation value generator (MLD) 163 and a multiplier 164.

The position tracer (POS) 162 may prove a pixel position (x,y) corresponding to an input pixel value I(x,y). The pixel position (x,y) may be determined according to the data line connecting the pixel to the data driver 230 in FIG. 2B and the scan line connecting the pixel to the scan driver 240 in FIG. 2B.

The coefficient generator (COE) 161 may generate a proportional coefficient LEC corresponding to the global current value Avg. For example, the coefficient generator 161 may provide the proportional coefficient LEC using a coefficient table LECT stored in the memory (MEM) 300.

The maximum local compensation value generator (MLD) 163 may generate a maximum local compensation value MLIC(x,y) corresponding to the position (x,y) of the pixel. For example, the maximum local compensation value generator 163 may generate the maximum local compensation value MLIC(x,y) using a local luminance deviation table LLDT stored in the memory 300.

The multiplier 164 may provide, as the local compensation value LIC(x,y), a multiplied value of the maximum local compensation value MLIC(x,y) and the proportional coefficient LEC.

In FIG. 11A, the horizontal axes denote the pixel position (x,y) and the vertical axis denotes the maximum local compensation value MLIC(x,y). Referring to FIG. 11A, the maximum local compensation value MLIC(x,y) in the local luminance deviation table LLDT may be represented by a positive value with respect to a reference value such as a common voltage of the display panel. Even though not illustrated, the maximum local compensation value MLIC (x,y) in the local luminance deviation table LLDT may be represented by a negative value. FIG. 11A illustrates the continuous maximum local compensation value MLIC(x,y) but, in some embodiments, the local luminance deviation table LLDT may include sampled discrete values for some pixels to reduce the size of the memory (MEM) 300. The local luminance deviation table LLDT may have various forms of distribution and FIG. 11A illustrates one example that the maximum local compensation value MLIC(x,y) increases as the pixel position (x,y) approaches the center portion of the display panel.

In FIG. 11B, the horizontal axis denotes the global current value Avg and the vertical axis denotes the proportional coefficient LEC. The graphs H1, H2 and H3 of FIG. 11B represent examples of the coefficient table LECT corresponding to the display panels having different operational characteristics. The display panel may have the various graphs of the coefficient table LECT depending on the characteristics of the display panel such as thin-film transistors, the light emission efficiency of the display panel, etc. In addition, the graphs may be different according to the pixel color.

Example embodiments are not limited to the examples of FIGS. 10, 11A and 11B, and the compensation of the local voltage drop may be performed variously.

FIGS. 12A through 13B are diagrams illustrating compensation of a voltage drop according to example embodiments.

Figure 12A:
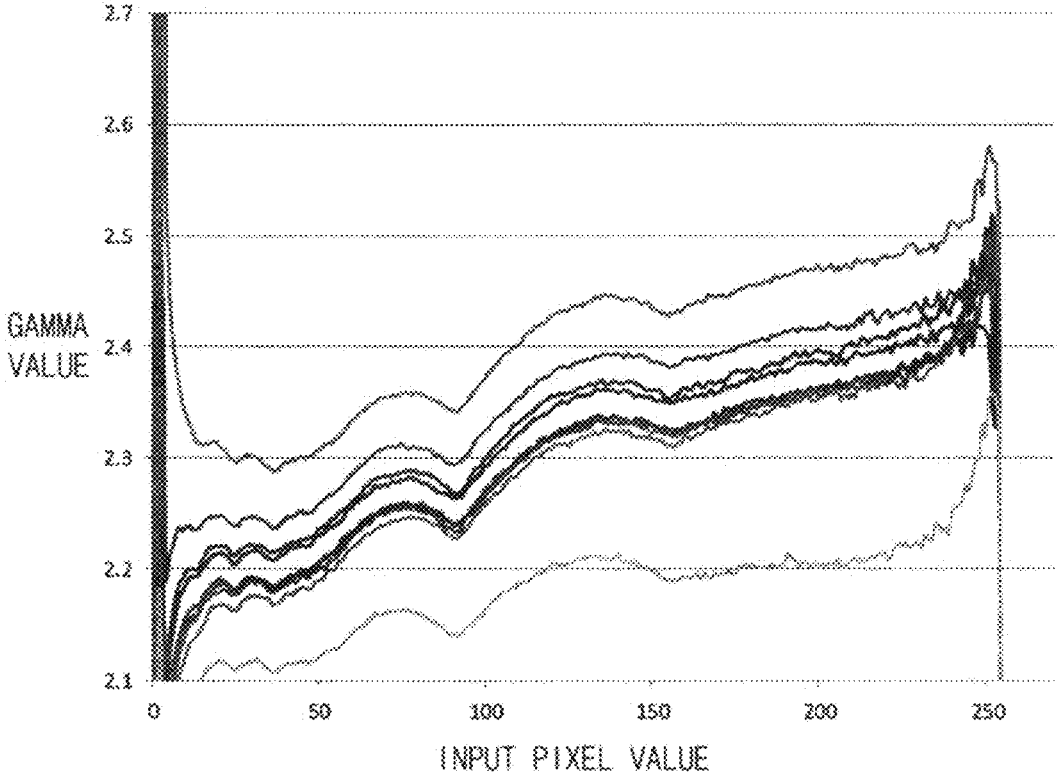
Figure 12B:
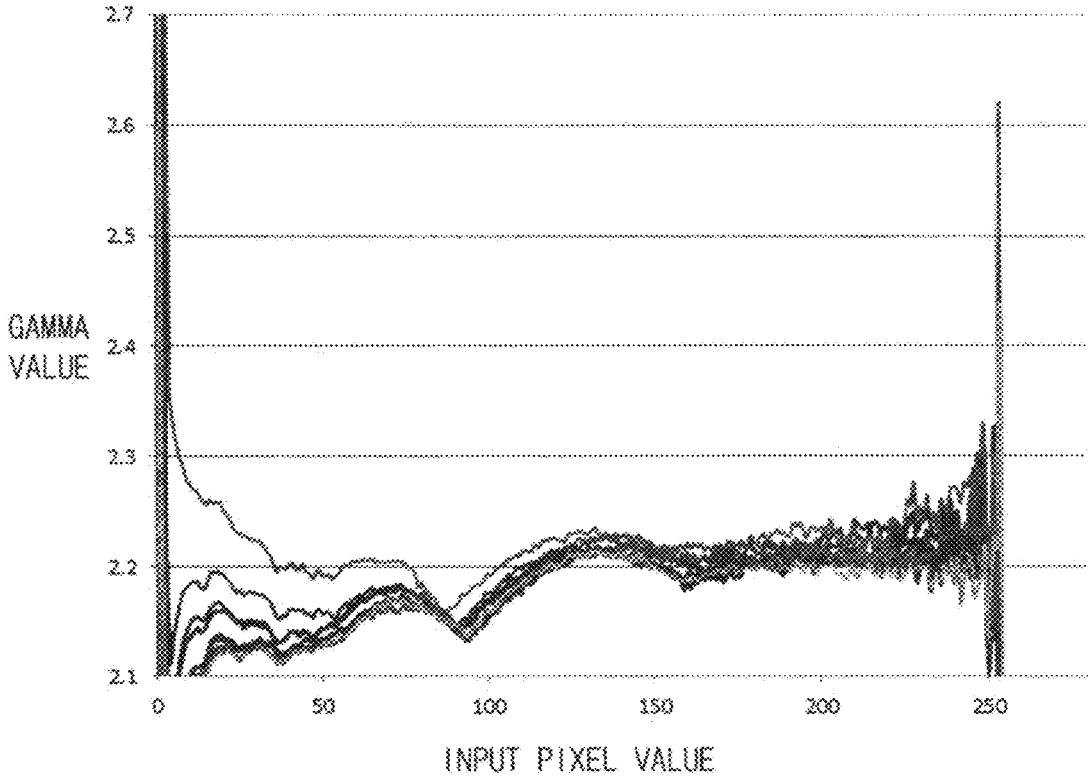

With respect to various input images BLK and IMG1~IMG6, FIGS. 12A and 13A illustrate results when the method according to example embodiments is not applied and FIGS. 12B and 13B illustrate results when the method according to example embodiments is applied.

In FIGS. 12A and 12B, the horizontal axis denotes the input pixel value and the vertical axis denotes the gamma value. The estimation metric used in FIGS. 12A and 12B is represented by Expression 7.

$$\text{Gamma Value}=\log((L(p)-L(0))/(L(255)-L(0))/\text{Log}(p/255) \quad \text{Expression 7}$$

In Expression 7, p denotes the input pixel value, L(p) denotes a luminance corresponding to the input pixel value p, and 255 is the maximum pixel value when the bit number of the pixel values is eight.

In comparison with the case of FIG. 12A, the case of FIG. 12B shows that the deviation of the gamma value is reduced and converges to the value of 2.2.

The estimation metric used in FIGS. 13A and 13B is represented by Expression 8.

$$\text{Luminance ratio } Y(\%)=100\times(\text{measured } L./\text{target } L.) \quad \text{Expression 8}$$

In comparison with the case of FIG. 13A, the case of FIG. 13B shows that the ratio Y of the measured luminance (L) with respect to the target luminance converges to 100% and thus the luminance uniformity may be enhanced.

As such, the electroluminescent display device and the method of compensating luminance according to example embodiments may enhance luminance uniformity significantly by compensating the input pixel values reflecting gamma distortion in addition to luminance deviation due the voltage drop of the display panel.

The analog gamma module for providing the data voltage to the display panel is tuned to have the constant gamma value while the voltage drop is not compensated, and thus the gamma value is distorted after the voltage drop is compensated. To address the problem, example embodiments may perform the gamma compensation function as represented by Expression 6 and Expression 6-1. The gamma compensation value GC(I(x,y))=GC(P) may be determined by Expression 9.

$$GC(P) = GC(I(x, y)) = (Pmax + LIC(Ipmax, xc, yc) - LICmax) * (P/Pmax) - (P + LIC(Ip, xc, yc) + GIC(P)) \quad \text{Expression 9}$$

In Expression 9, (x,y) denotes coordinates of a pixel, P=I(x,y) denotes the input pixel value corresponding to the pixel, GC(P) denotes the gamma compensation value when the input pixel value is P, Pmax denotes a maximum pixel value, Ip denotes an input image where all pixels values are P, Ipmax denotes an input image where all pixels values are Pmax, LIC(Ip, xc, yc) denotes the local compensation value at (xc,yc) indicating a center position of the display panel when Ip is input, LIC(Ipmax, xc, yc) denotes the local compensation value at (xc,yc) when Ipmax is input, and LICmax denotes a maximum value of the local compensation value when Ipmax is input.

The first term (Pmax+LIC(Ipmax,xc,yc)−LICmax)*(P/Pmax) in Expression 9 corresponds to the target gamma compensation value, and the second term (P+LIC(Ip,xc,yc)+GIC(P)) in Expression 9 corresponds to the result of the global compensation and the local compensation when the gamma compensation is not applied. Therefore, the gamma compensation value GC(P) may correspond to the result of transforming the second term using the first term. The first term represents the compensation value when the maximum local voltage drop occurs. In other words, the first term represents the compensation value capable of outputting the maximum luminance at the center position of the display panel. As such the final compensated pixel value may satisfy linearity with the input pixel value while the local voltage drop is compensated using the first term.

According to example embodiments, a gamma compensation table may be provided to implement the gamma compensation function with hardware, and the gamma compensation value may be determined as Expression 10.

$$GC(P)=GC(I(x,y))=LIC\max*Wgc_dbv*Intp\{GCT(P)\} \quad \text{Expression 10}$$

In Expression 10, GCT denotes the gamma compensation table, Wgc_dbv indicate a weight parameter. The weight parameter Wgc_dbv may be varied depending on the luminance setting value DBV. For example, the weight parameter Wgc_dbv may be determined experimentally.

FIGS. 14A through 15B are diagrams illustrating gamma compensation according to example embodiments.

Figure 14A:
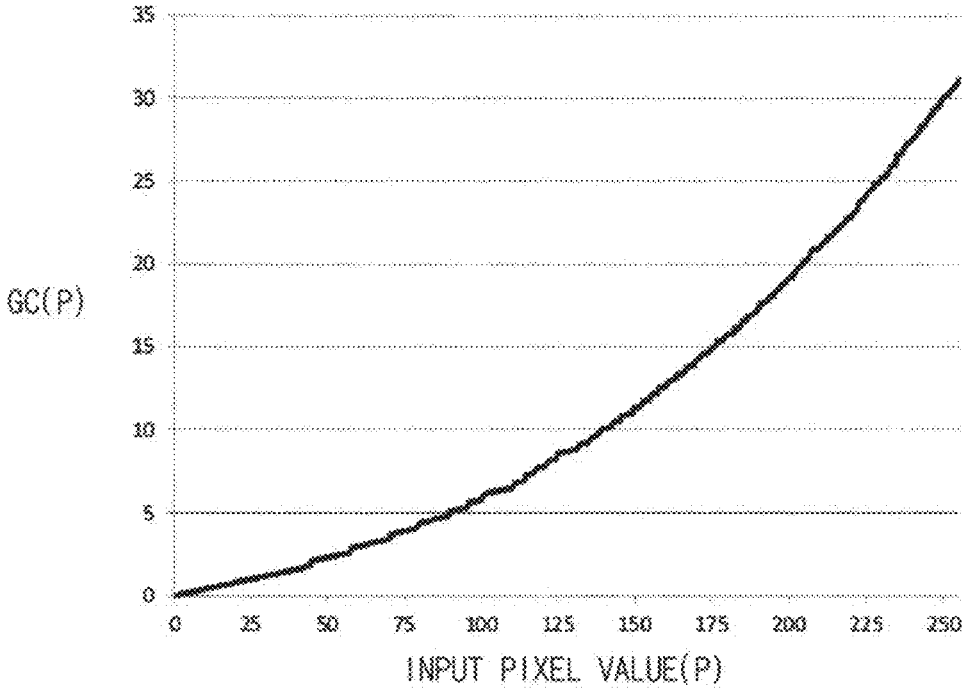
FIGS. 14A through 15B are diagrams illustrating gamma compensation according to example embodiments.
Figure 14B:
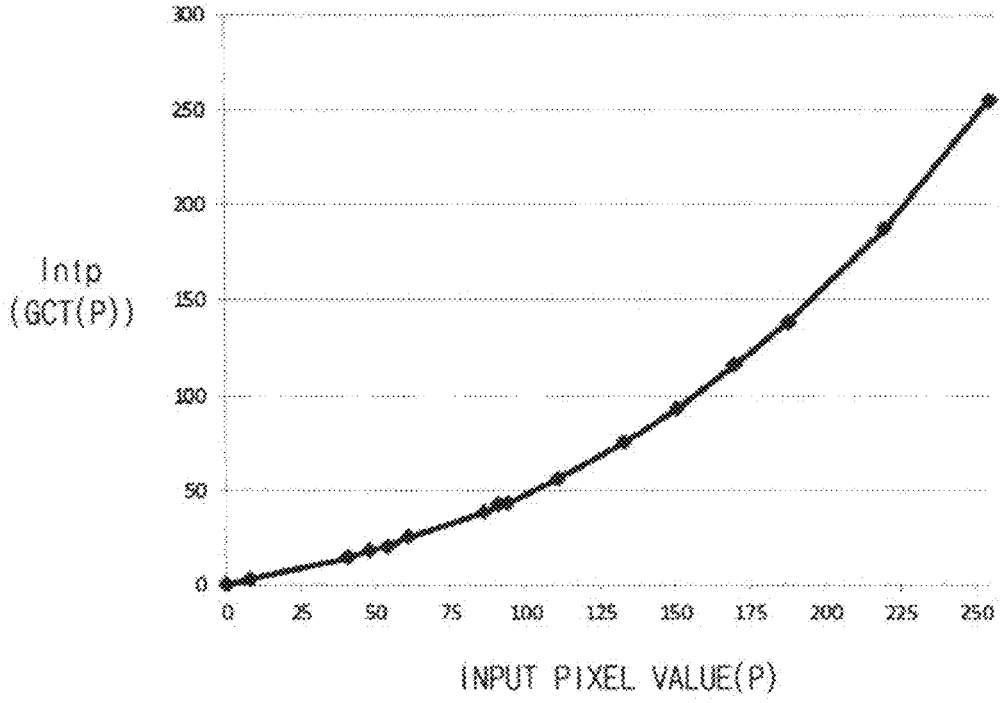

FIG. 14A represents the gamma compensation value GC(P) calculated according to Expression 9, and FIG. 14B represents the interpolation operation corresponding to Expression 10.

Using the gamma compensation value GC(P) of FIG. 14A, the gamma compensation table GCT including a plurality of gamma compensation values corresponding to a plurality pixels may be provided. The gamma compensation table GCT may be stored in memory (MEM) 300 as described with reference to FIGS. 5B and 5C, and the gamma compensation circuit (GMCC) 140 in FIG. 3 may generate the gamma compensation value GC(P) using the stored gamma compensation table GCT.

Considering the size of the memory (MEM) 300, the gamma compensation table GCT may include the gamma compensation values of a portion of the plurality of pixels. In this case, the gamma compensation circuit (GMCC) 140 may extract reference gamma compensation values adjacent to the input pixel value from the gamma compensation table and generate the gamma compensation value corresponding to the input pixel value by performing an interpolation operation with respect to the reference gamma compensation values.

Figure 15A:
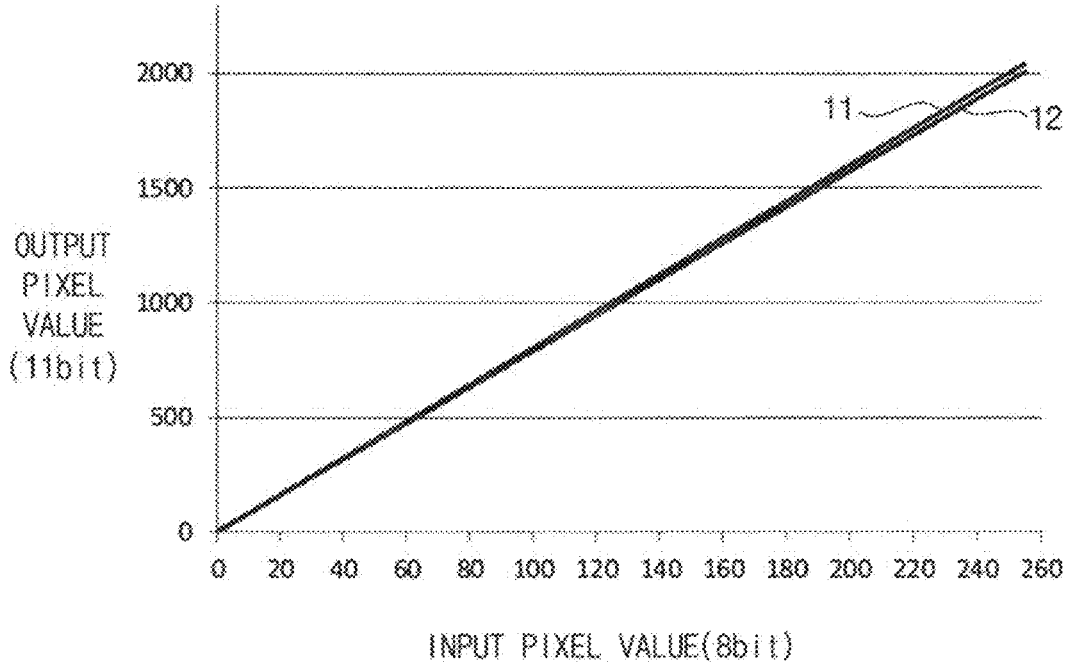
Figure 15B:
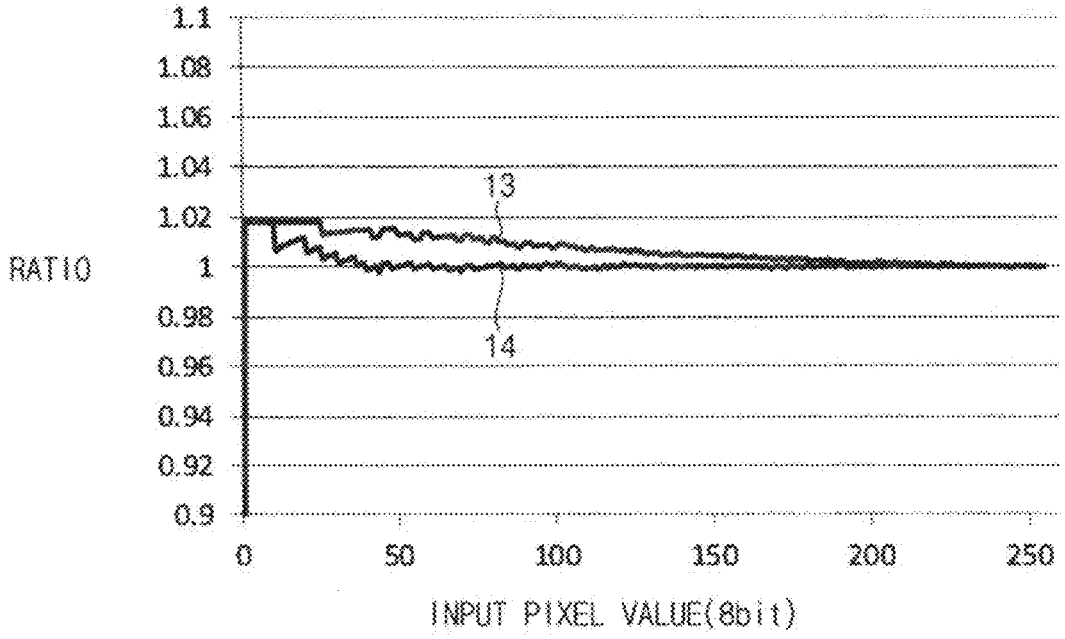

FIGS. 15A and 15B illustrate an effect of the gamma compensation.

In FIG. 15A, the horizontal axis denotes the input pixel value of eight bits and the vertical axis denotes the output pixel value converted into eleven bits. In FIG. 15B, the horizontal axis denotes the input pixel value of eight bits and the vertical axis denotes a ratio of diving O/Omax by I/Imax. Here O denotes the output pixel value, Omax denotes the maximum output pixel value, I denotes the input pixel value and Imax denotes the maximum input pixel value.

In FIGS. 15A and 15B, the graphs 11 and 13 denotes the results when only the voltage drop is compensated and the graphs 12 and 14 denotes the results when both of the voltage drop and the gamma distortion are compensated.

The graph 11 may be enhanced into the graph 12 through the gamma compensation as in FIG. 15A, and the input and the output may be uniform as in FIG. 15B.

As such, the luminance uniformity may be enhanced significantly by compensating the input pixel values reflecting gamma distortion in addition to luminance deviation due the voltage drop of the display panel.

Figure 16:
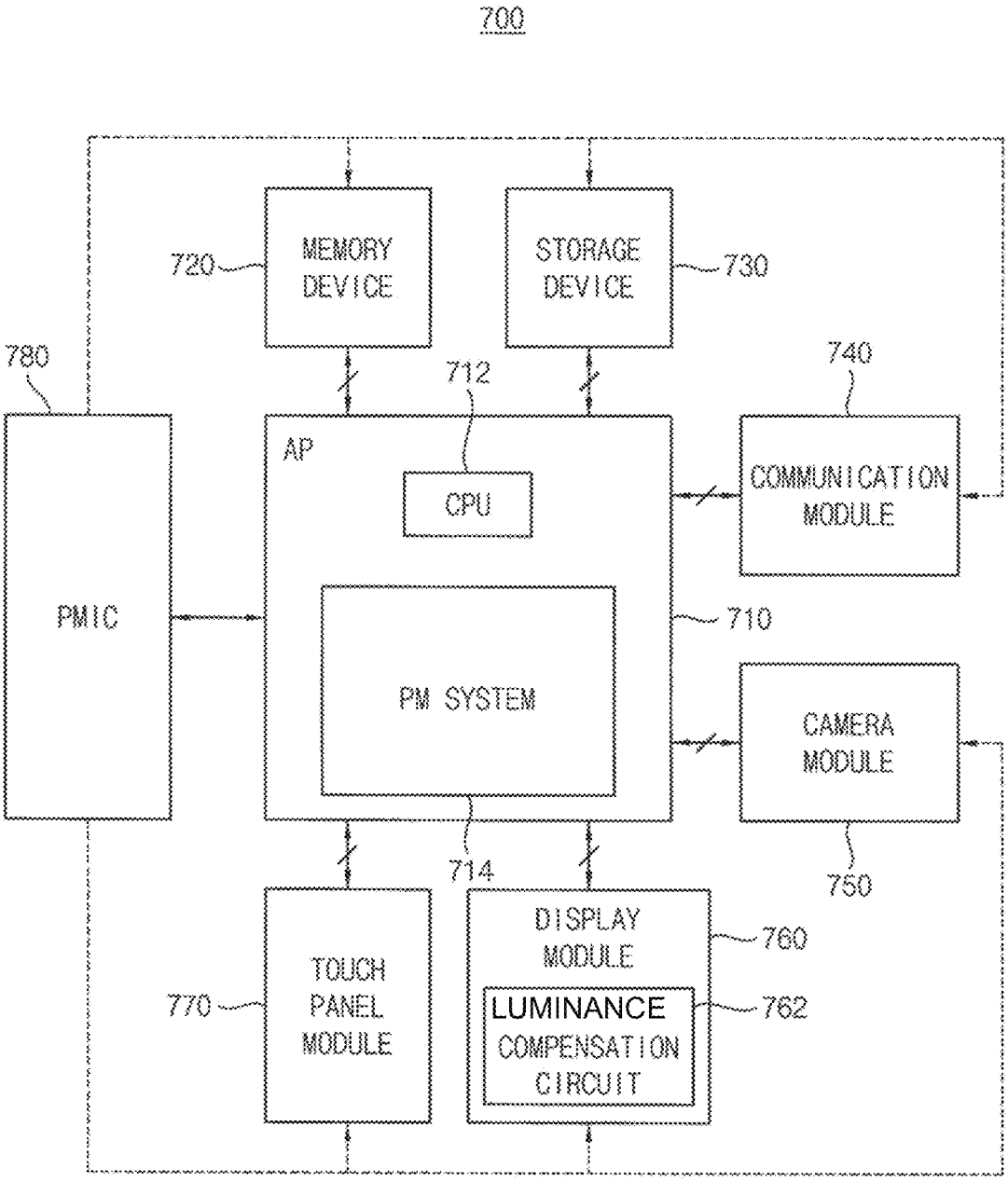
FIG. 16 is a block diagram illustrating a mobile device according to example embodiments.

FIG. 16 is a block diagram illustrating a mobile device according to example embodiments.

Referring to FIG. 16, a mobile device 700 includes a system on chip ("SoC") 710 and a plurality of functional modules 740, 750, 760 and 770. The mobile device 700 may further include a memory device 720, a storage device 730 and a power management device 780.

The SoC 710 controls overall operations of the mobile device 700. In an example embodiment, the SoC 710 controls the memory device 720, the storage device 730 and the plurality of functional modules 740, 750, 760 and 770, for example. The SoC 710 may be an application processor ("AP") that is included in the mobile device 700.

The SoC 710 may include a CPU 712 and a power management system PM SYSTEM 714. The memory device 720 and the storage device 730 may store data for operations of the mobile device 700. In an exemplary embodiment, the memory device 720 may include a volatile memory device, such as a dynamic random access memory ("DRAM"), a static random access memory ("SRAM"), a mobile DRAM, etc. In an exemplary embodiment, the storage device 730 may include a nonvolatile memory device, such as an erasable programmable read-only memory ("EPROM"), an electrically EPROM ("EEPROM"), a flash memory, a phase change random access memory ("PRAM"), a resistance random access memory ("RRAM"), a nano floating gate memory ("NFGM"), a polymer random access memory ("PoRAM"), a magnetic random access memory ("MRAM"), a ferroelectric random access memory ("FRAM"), etc. In exemplary embodiments, the storage device 730 may further include a solid state drive ("SSD"), a hard disk drive ("HDD"), a CD-ROM, etc.

The functional modules 740, 750, 760 and 770 perform various functions of the mobile device 700. In an exemplary embodiment, the mobile device 700 may include a communication module 740 that performs a communication function (e.g., a code division multiple access ("CDMA") module, a long term evolution ("LTE") module, a radio frequency (RF) module, an ultra-wideband ("UWB") module, a wireless local area network (WLAN) module, a worldwide interoperability for a microwave access ("WIMAX") module, etc.), a camera module 750 that performs a camera function, a display module 760 that performs a display function, a touch panel module 770 that performs a touch sensing function, etc., for example. In exemplary embodiments, the mobile device 700 may further include a global positioning system ("GPS") module, a microphone ("MIC") module, a speaker module, a gyroscope module, etc., for example. However, the functional modules 740, 750, 760, and 770 in the mobile device 700 are not limited thereto.

The power management device 780 may provide an operating voltage to the SoC 710, the memory device 720, the storage device 730 and the functional modules 740, 750, 760 and 770.

According to example embodiments, the display module 760 includes a luminance compensation circuit 762 as described above.

As such, the electroluminescent display device and the method of compensating luminance according to example embodiments may enhance luminance uniformity significantly by compensating the input pixel values reflecting gamma distortion in addition to luminance deviation due the voltage drop of the display panel. In addition, the electroluminescent display device and the method of compensating luminance according to example embodiments may enhance luminance uniformity by compensating the luminance deviation and the gamma distortion through a digital scheme based on the input pixel values better than an analog scheme based on measurement and control of current and/or voltage.

The present inventive concept may be applied to an electroluminescent display device requiring luminance uniformity and any devices and systems including the electroluminescent display device. For example, the present inventive concept may be applied to systems such as a mobile phone, a smart phone, a personal digital assistant (PDA), a portable multimedia player (PMP), a digital camera, a camcorder, a personal computer (PC), a server computer, a workstation, a laptop computer, a digital TV, a set-top box, a portable game console, a navigation system, a wearable device, an internet of things (IoT) device, an internet of everything (IoE) device, an e-book, a virtual reality (VR) device, an augmented reality (AR) device, etc.

The foregoing is illustrative of example embodiments and is not to be construed as limiting thereof. Although a few example embodiments have been described, those skilled in the art will readily appreciate that many modifications are possible in the example embodiments without materially departing from the present inventive concept.

What is claimed is:

1. A method of compensating luminance in an electroluminescent display device including a display panel including a plurality of pixels, the method comprising:

generating a global current value based on a plurality of input pixel values corresponding to the plurality of pixels, the global current value indicating a global current flowing through the display panel; and for each of the plurality of input pixel values:

generating a global compensation value indicating a global luminance deviation according to the global current based on the input pixel value and the global current value;

generating a gamma compensation value indicating a gamma distortion based on the input pixel value, the gamma distortion being caused by compensating the input pixel value; and generating a compensated pixel value based on the input pixel value, the global compensation value and the gamma compensation value.

2. The method of claim 1, wherein generating the global current value includes:

providing the global current value based on a sum of respective multiplied values of the plurality of input pixel values and current ratios of colors of the plurality of pixels.

3. The method of claim 2, further comprising:

normalizing the global current value such that a maximum value of the global current value corresponds to a maximum pixel value of the plurality of input pixel values, wherein for each of the plurality of input pixel values;

the global compensation value is generated based on the normalized global current value.

4. The method of claim 1, wherein for each of the plurality of input pixel values generating the global compensation value includes:

providing a luminance function indicating a luminance value corresponding to a combination of each of a plurality of pixel values and each of a plurality of global current values;

generating a target luminance value corresponding to the input pixel value; and generating, using an inverse function of the luminance function, the global compensation value corresponding to a combination of the target luminance value and the global current value.

5. The method of claim 4, wherein for each of the plurality of input pixel values, the target luminance value and the global compensation value are determined by flowing expressions, respectively:

$$GIC(I(x,y))=f^{-1}(Lt(x,y),Avg)-I(x,y)$$

$$Lt(x,y)=L\max*\{I(x,y)/I\max\}^{G}$$

wherein (x,y) denotes coordinates of a pixel, GIC(I(x,y)) denotes the global compensation value corresponding to the pixel, $f^{-1}$ denotes the inverse function of the luminance function, Lt(x,y) denotes the target luminance value corresponding to the pixel, Avg denotes the global current value, I(x,y) denotes the input pixel value corresponding to the pixel, Lmax denotes a maximum luminance value, Imax denotes a maximum input pixel value and G denotes a gamma value.

6. The method of claim 1, wherein for each of the plurality of input pixel values generating the global compensation value includes:

providing a global luminance deviation table including a plurality of global compensation values corresponding to different combinations of a plurality of pixels values and a plurality of global current values; and generating the global compensation value using the global luminance deviation table.

7. The method of claim 6, wherein generating the global compensation value using the global luminance deviation table includes:

extracting reference global compensation values adjacent to the input pixel value and the global current value from the global luminance deviation table; and generating the global compensation value corresponding to a combination of the input pixel value and the global current value by performing an interpolation operation with respect to the reference global compensation values.

8. The method of claim 6, wherein, in the global luminance deviation table, the global compensation value decreases as the input pixel value increases, and the global compensation value increases as the global current value increases.

9. The method of claim 1, further comprising:

for each of the plurality of input pixel values;

generating a local compensation value indicating a local luminance deviation according to a position of a pixel corresponding to the input pixel value, based on the input pixel value and the global current value.

10. The method of claim 9, wherein for each of the plurality of input pixel values generating the local compensation value includes:

generating a proportional coefficient corresponding to the global current value;

generating a maximum local compensation value corresponding to the position of the pixel; and providing, as the local compensation value, a multiplied value of the maximum local compensation value and the proportional coefficient.

11. The method of claim 9, wherein for each of the plurality of input pixel values generating the compensated pixel value includes:

providing, as the compensated pixel value, a sum of the input pixel value, the global compensation value for the input pixel value, the local compensation value for the input pixel value and the gamma compensation value for the input pixel value.

12. The method of claim 11, wherein the gamma compensation value for the input pixel value is determined by a following equation:

$$GC(P) = GC(I(x, y)) = (Pmax + LIC(Ipmax, xc, yc) - LICmax) * (P/Pmax) - (P + LIC(Ip, xc, yc) + GIC(P))$$

wherein (x,y) denotes coordinates of a pixel, P=I(x,y) denotes the input pixel value corresponding to the pixel, GC(P) denotes the gamma compensation value when the input pixel value is P, Pmax denotes a maximum pixel value, Ip denotes an input image where all pixels values are P, Ipmax denotes an input image where all pixels values are Pmax, LIC(Ip, xc, yc) denotes the local compensation value at (xc,yc) indicating a center position of the display panel when Ip is input, LIC(Ipmax, xc, yc) denotes the local compensation value at (xc,yc) when Ipmax is input, and LICmax denotes a maximum value of the local compensation value when Ipmax is input.

13. The method of claim 1, wherein for each of plurality of input pixel values generating the gamma compensation value includes:

providing a gamma compensation table including a plurality of gamma compensation values corresponding to a plurality of pixel values; and generating the gamma compensation value using the gamma compensation table.

14. The method of claim 13, wherein for each of the plurality of input pixel values generating the gamma compensation value using the gamma compensation table includes:

extracting reference gamma compensation values adjacent to the input pixel value from the gamma compensation table; and generating the gamma compensation value corresponding to the input pixel value by performing an interpolation operation with respect to the reference gamma compensation values.

15. The method of claim 1, wherein for each of the plurality of input pixel values generating the compensated pixel value includes:

providing, as the compensated pixel value, a sum of the input pixel value, the global compensation value for the input pixel value and the gamma compensation value for the input pixel value.

16. The method of claim 1, further comprising for each of the plurality of input pixel values, compensating the luminance according to the compensated pixel value for the input pixel value.

17. A method of generating a compensated pixel value for compensating luminance in an electroluminescent display device including a display panel including a plurality of pixels, the method comprising:

generating a global current value based on a plurality of input pixel values corresponding to the plurality of pixels, the global current value indicating a global current flowing through the display panel;

providing a global luminance deviation table including a plurality of global compensation values corresponding to different combinations of a plurality of pixels values and a plurality of global current values;

for each of the plurality of input pixel values:

generating a global compensation value indicating a global luminance deviation according to the global current using the global luminance deviation table;

generating a gamma compensation value indicating a gamma distortion based on the input pixel value, the gamma distortion being caused by compensating the input pixel value;

generating a local compensation value indicating a local luminance deviation according to a position of a pixel corresponding to the input pixel value, based on the input pixel value and the global current value; and generating the compensated pixel value corresponding to a sum of the input pixel value, the global compensation value, the local compensation value and the gamma compensation value.

18. The method of claim 17, wherein for the each of plurality of input pixel values, generating the global compensation value using the global luminance deviation table includes:

extracting reference global compensation values adjacent to the input pixel value and the global current value from the global luminance deviation table; and generating the global compensation value corresponding to a combination of the input pixel value and the global current value by performing an interpolation operation with respect to the reference global compensation values.

19. The method of claim 17, wherein for each of the plurality of input pixel values, generating the gamma compensation value includes:

providing a gamma compensation table including a plurality of gamma compensation values corresponding to a plurality of pixel values; and generating the gamma compensation value using the gamma compensation table.

20. An electroluminescent display device comprising:

a display panel including a plurality of pixels; and a luminance compensation circuit configured to, based on a plurality of input pixel values corresponding to the plurality of pixels:

generate a global current value indicating a global current flowing through the display panel, and for each of the plurality of input pixel values, generate a global compensation value indicating a global luminance deviation according to the global current, a local compensation value indicating a local luminance deviation according to a position of a pixel corresponding to the input pixel value, and a gamma compensation value indicating a gamma distortion caused by compensating the input pixel value, and generate a compensated pixel value based on the input pixel value, the global compensation value, the local compensation value and the gamma compensation value.

* * * * *